US005197922A

United States Patent [19]

Schubert

[11] Patent Number: 5,197,922

[45] Date of Patent: Mar. 30, 1993

[54] METHOD AND APPARATUS FOR PRODUCING TWO-SIDED CARBONLESS COPIES OF BOTH SIDES OF AN ORIGINAL DOCUMENT

[76] Inventor: Keith E. Schubert, 4 Timothy Rd., W. Norwalk, Conn. 06850

[21] Appl. No.: 436,189

[22] Filed: Nov. 13, 1989

Related U.S. Application Data

[63] Continuation-in-part of Ser. No. 334,183, Apr. 6, 1989, Pat. No. 5,127,879.

[51] Int. Cl.[5] ..... B41L 1/26

[52] U.S. Cl. ..... 462/2; 281/15.1; 281/2; 281/5; 462/8; 462/17; 462/25; 462/54; 462/55; 462/56

[58] Field of Search ..... 283/66.1, 61, 62, 103, 283/105, 117; 281/15.1, 2, 5, 29, 35, 51; 282/11.5 R, 18 A, 12 R, 12 A, 8 R, 1 R, 3 R, 2, 22 R, 15 B; 462/2, 6, 8, 17, 25, 54, 55, 56, 84

[56] References Cited

U.S. PATENT DOCUMENTS

| | | | |
|---|---|---|---|
| Re. 30,041 | 7/1979 | Maalouf | 282/27.5 |
| Re. 30,116 | 10/1979 | Maalouf | 282/27.5 |
| Re. 31,695 | 10/1984 | Zink | 427/211 |
| 371,126 | 10/1887 | Currie . | |
| 396,560 | 1/1889 | Harrison et al. . | |
| 418,455 | 12/1889 | Gray . | |
| 419,359 | 1/1890 | Rogers . | |
| 445,368 | 1/1891 | Campbell . | |
| 664,384 | 12/1900 | Cooke . | |
| 683,782 | 10/1901 | Morland . | |
| 756,258 | 4/1904 | Mallin . | |
| 765,408 | 7/1904 | Wildey . | |
| 797,302 | 8/1905 | Meacham . | |
| 897,783 | 9/1908 | Reynolds . | |
| 971,283 | 9/1910 | Krueger . | |
| 972,549 | 10/1910 | Lewis . | |
| 1,101,262 | 6/1914 | Edmonds . | |
| 1,187,682 | 6/1916 | Trueman | 282/12 |
| 1,301,834 | 4/1919 | Gilman . | |
| 1,392,748 | 10/1921 | Davidson . | |
| 1,468,094 | 9/1923 | Wherry . | |
| 1,873,997 | 8/1932 | Davis . | |
| 1,980,318 | 11/1934 | Caton . | |
| 1,980,319 | 11/1934 | Caton . | |
| 2,006,034 | 6/1935 | Stevens . | |
| 2,035,768 | 3/1936 | Sherman et al. | 91/68 |
| 2,084,221 | 6/1937 | Schutz | 282/28 |
| 2,093,086 | 9/1937 | Luzzatto | 282/27 |
| 2,098,706 | 11/1937 | Lawson et al. | 282/12 |
| 2,118,888 | 5/1938 | Lewis et al. | 101/131 |
| 2,131,381 | 9/1938 | Linderman | 282/28 |

(List continued on next page.)

FOREIGN PATENT DOCUMENTS

| | | |
|---|---|---|
| 549442 | 4/1932 | Fed. Rep. of Germany . |
| 613658 | 3/1926 | France . |
| 128558 | 2/1962 | New Zealand . |
| 128915 | 3/1964 | New Zealand . |
| 185282 | 11/1980 | New Zealand . |
| 1347807 | 2/1974 | United Kingdom . |
| 2085359 | 4/1982 | United Kingdom . |

OTHER PUBLICATIONS

Black Clawson Brochure.
"Flip-N-Rite", 7-page instructions by Gary Thompson
FORM Magazine, Feb., 1989, pp. 74-80.
Business Forms Labels & Systems, Jul. 1990, p. 48.
"Pressure Sensitive Papers", Project 2558, No. 222, TAPPI Coating Committee, 1965.
"Pressure Sensitive Papers", Project 2558, TAPPI Coating Committee, Dec., 1967.
Facsimiles of BH Medical, MAP Phone Message, Moore Two-Way Rite, St. Vincent Medical Center, Maybelline and Hartz Mountain forms.

*Primary Examiner*—Paul A. Bell
*Attorney, Agent, or Firm*—Gerald E. Linden

[57] ABSTRACT

A single sheet of paper is delineated into two or more panels, and is coated with carbonless treatment so that information entered on both sides of one of the panels is reproduces onto the other panel(s). The use of carbonless CB and CF, and carbonless SC coatings is disclosed. Methods of making and using the carbonless paper are also disclosed.

37 Claims, 14 Drawing Sheets

U.S. PATENT DOCUMENTS

| | | | |
|---|---|---|---|
| 2,148,886 | 2/1939 | Wanser | 229/69 |
| 2,168,098 | 8/1939 | Groák | 282/26 |
| 2,194,670 | 3/1940 | Neu | 282/27 |
| 2,211,532 | 8/1940 | Biggs | 282/12 |
| 2,220,842 | 11/1940 | Hano | 282/12 |
| 2,226,722 | 12/1940 | Jones | 282/22 |
| 2,257,766 | 10/1941 | Sherman | 282/3 |
| 2,262,347 | 11/1941 | Sturc | 282/26 |
| 2,264,119 | 11/1941 | Lichter | 283/1 |
| 2,327,215 | 8/1943 | Potter | 282/12 |
| 2,458,729 | 1/1949 | Politzer | 40/102 |
| 2,470,586 | 5/1949 | Tathwell | 282/9 |
| 2,503,680 | 4/1950 | Newman | 282/19 |
| 2,548,366 | 4/1951 | Green et al. | 282/28 |
| 2,550,466 | 4/1951 | Green et al. | 282/28 |
| 2,550,468 | 4/1951 | Green et al. | 282/28 |
| 2,550,469 | 4/1951 | Green et al. | 282/28 |
| 2,606,775 | 8/1952 | Newman | 282/28 |
| 2,618,573 | 11/1952 | Green | 117/36 |
| 2,637,571 | 5/1953 | Tilly | 281/5 |
| 2,694,429 | 11/1954 | Berger | 150/39 |
| 2,712,507 | 7/1955 | Green | 117/36 |
| 2,802,678 | 8/1957 | Bright | 282/22 |
| 2,869,898 | 1/1959 | Martin . | |
| 2,870,040 | 1/1959 | Gill | 117/36 |
| 2,907,585 | 10/1959 | Sornberger | 282/22 |
| 2,980,447 | 4/1961 | Weger | 282/22 |
| 3,016,308 | 1/1962 | Macaulay | 117/36.7 |
| 3,104,799 | 9/1963 | Steidinger | 229/69 |
| 3,364,052 | 1/1968 | Martino | 117/15 |
| 3,376,154 | 4/1968 | Campbell et al. | 117/364 |
| 3,429,827 | 2/1969 | Ruus | 252/316 |
| 3,481,759 | 12/1969 | Ostlie | 117/36.2 |
| 3,539,375 | 11/1970 | Baum | 117/36.2 |
| 3,625,547 | 12/1971 | Burke | 282/23 |
| 3,6[illegible]2,681 | 8/1972 | Kunkel | 117/36.2 |
| 3,769,057 | 10/1973 | Lin | 117/36.2 |
| 3,769,062 | 10/1973 | Ishige et al. | 117/36.2 |
| 3,825,467 | 7/1974 | Phillips, Jr. | 161/159 |
| 3,854,654 | 12/1974 | Van Malderghem | 229/69 |
| 3,902,655 | 9/1975 | Huffman | 229/69 |
| 3,908,063 | 1/1975 | Rosendale et al. | 428/320 |
| 3,945,870 | 3/1976 | Johnsen | 156/201 |
| 3,955,750 | 5/1976 | Huffman | 229/69 |
| 3,963,853 | 6/1976 | Hughes et al. | 428/326 |
| 3,968,299 | 7/1976 | Angleman | 428/307 |
| 3,981,523 | 9/1976 | Maalouf | 282/27.5 |
| 3,988,971 | 11/1976 | Steidinger | 93/63 M |
| 3,996,406 | 12/1976 | Alsop | 428/307 |
| 4,000,916 | 1/1977 | Lucas | 282/11.5 |
| 4,036,511 | 7/1977 | Maalouf | 282/27.5 |
| 4,039,046 | 7/1977 | D'Luhy | 282/22 R |
| 4,045,053 | 8/1977 | Carriere | 282/22 R |
| 4,046,404 | 9/1977 | Treier | 282/27.5 |
| 4,056,191 | 11/1977 | Weisenfluh | 206/629 |
| 4,062,567 | 12/1977 | Macaulay | 282/27.5 |
| 4,063,754 | 12/1977 | Shackle et al. | 282/27.5 |
| 4,081,127 | 3/1978 | Steidinger | 229/69 |
| 4,081,188 | 3/1978 | Westcott | 282/27.5 |
| 4,091,122 | 5/1978 | Davis et al. | 427/44 |
| 4,095,695 | 6/1978 | Steidinger | 206/620 |
| 4,097,619 | 6/1978 | Davis et al. | 427/44 |
| 4,111,461 | 9/1978 | Levensalor | 282/27.5 |
| 4,112,138 | 9/1978 | Davis et al. | 427/54 |
| 4,113,281 | 9/1978 | Halse | 282/11.5 A |
| 4,121,857 | 10/1978 | Halse | 282/11.5 A |
| 4,126,334 | 11/1978 | Van Malderghem | 282/22 R |
| 4,137,343 | 1/1979 | Davis et al. | 427/150 |
| 4,138,302 | 2/1979 | D'Luhy | 156/216 |
| 4,139,218 | 2/1979 | Davis et al. | 282/27.5 |
| 4,139,392 | 2/1979 | Davis et al. | 106/14.5 |
| 4,143,890 | 3/1979 | Davis et al. | 282/27.5 |
| 4,143,891 | 3/1979 | Neubauer | 282/27.5 |
| 4,165,101 | 8/1979 | Sternberg | 282/27.5 |
| 4,168,851 | 9/1979 | Halse | 282/11.5 A |
| 4,172,605 | 10/1979 | Welsch et al. | 282/27.5 |
| 4,178,018 | 12/1979 | Halse | 282/11.5 A |
| 4,198,446 | 4/1980 | Goetz | 427/150 |
| 4,199,174 | 4/1980 | Sornberger | 282/27.5 |
| 4,203,619 | 5/1980 | Sanders | 282/27.5 |
| 4,208,460 | 6/1980 | Knechtle et al. | 428/195 |
| 4,217,162 | 8/1980 | Glanz et al. | 156/305 |
| 4,282,275 | 8/1981 | Werner | 427/428 |
| 4,336,067 | 6/1982 | Shackle et al. | 106/21 |
| 4,343,494 | 8/1982 | Ehrhardt et al. | 282/27.5 |
| 4,352,855 | 10/1982 | Hiraishi et al. | 428/320.4 |
| 4,354,449 | 10/1982 | Zink | 118/126 |
| 4,361,108 | 11/1982 | Robillard et al. | 118/265 |
| 4,381,120 | 4/1983 | Golden | 282/27.5 |
| 4,397,483 | 8/1983 | Hiraishi et al. | 282/27.5 |
| 4,407,524 | 10/1983 | Trautlein | 282/9 R |
| 4,425,386 | 1/1984 | Chang | 427/256 |
| 4,448,445 | 5/1984 | Chang et al. | 346/206 |
| 4,455,327 | 6/1984 | Yoshida et al. | 427/131 |
| 4,501,559 | 2/1985 | Griswold et al. | 434/154 |
| 4,512,595 | 4/1985 | Breen | 283/70 |
| 4,533,160 | 8/1985 | Malone | 282/23 R |
| 4,556,390 | 12/1985 | Rahn et al. | 434/433 |

(List continued on next page.)

U.S. PATENT DOCUMENTS

| | | | |
|---|---|---|---|
| 4,566,720 | 1/1986 | Goldman et al. | 281/15 R |
| 4,576,399 | 3/1986 | White et al. | 282/8 R |
| 4,583,765 | 4/1986 | Messinger | 282/8 R |
| 4,593,935 | 6/1986 | Kearns | 282/28 R |
| 4,597,993 | 7/1986 | Okada et al. | 427/150 |
| 4,614,362 | 9/1986 | Breen et al. | 282/9 R |
| 4,614,363 | 9/1986 | Breen | 282/22 R |
| 4,636,818 | 1/1987 | Jerabek | 346/213 |
| 4,642,662 | 2/1987 | Torii et al. | 346/215 |
| 4,657,783 | 4/1987 | Tatt et al. | 427/211 |
| 4,690,433 | 9/1987 | Showers et al. | 283/1 |
| 4,715,620 | 12/1987 | Thompson | 282/9 R |
| 4,722,553 | 2/1988 | Evans | 282/9 R |
| 4,740,015 | 4/1988 | Caprio et al. | 283/70 |
| 4,745,097 | 5/1988 | Maekawa et al. | 503/209 |
| 4,762,342 | 8/1988 | Thompson | 282/9 R |
| 4,814,319 | 3/1989 | Matsumoto et al. | 503/216 |
| 4,846,594 | 7/1989 | Riskin | 400/188 |
| 4,853,364 | 8/1989 | Liang et al. | 503/216 |
| 4,859,561 | 8/1989 | Metz et al. | 430/138 |
| 4,871,193 | 10/1989 | Wörndli | 283/72 |
| 4,877,767 | 10/1989 | Liang et al. | 503/212 |
| 4,912,080 | 3/1990 | Weinstein | 503/200 |
| 4,935,401 | 6/1990 | Pendergrass, Jr. | 503/206 |
| 4,938,507 | 7/1990 | Ashby et al. | 282/9 R |
| 4,947,343 | 7/1990 | Amari | 364/518 |
| 4,957,380 | 9/1990 | Gerstle et al. | 400/279 |
| 4,959,343 | 9/1990 | Weinstein | 503/200 |
| 4,970,193 | 11/1990 | Liang et al. | 503/201 |
| 4,974,035 | 11/1990 | Rabb et al. | 355/320 |
| 4,977,060 | 12/1990 | Liang et al. | 430/138 |
| 4,977,131 | 12/1990 | Macaulay | 503/201 |
| 4,996,184 | 2/1991 | Bevan et al. | 503/226 |
| 5,002,311 | 3/1991 | Brunjes | 282/9 R |
| 5,004,271 | 4/1991 | Piatt | 283/65 |

METHOD AND APPARATUS FOR PRODUCING TWO-SIDED CARBONLESS COPIES OF BOTH SIDES OF AN ORIGINAL DOCUMENT

CROSS-REFERENCE TO RELATED APPLICATIONS

This is a continuation-in-part of copending U.S. patent application Ser. No. 334,183, entitled METHOD AND APPARATUS FOR RECORDKEEPING, filed on Apr. 6, 1989 by Keith E. Schubert now U.S. Pat. No. 5,127,879.

TECHNICAL FIELD OF THE INVENTION

The invention relates to chemical carbonless paper technology and, more particularly, to a technique for producing a two-sided carbonless copy of both sides of an original document or form.

BACKGROUND OF THE INVENTION

Everyone who has used carbon paper for copying knows of its disadvantages. It smudges, it dirties the fingers, each sheet gradually deteriorates in efficiency, and it is time consuming to position the carbon paper accurately between the original and copy sheets. These factors led to the search for a substitute, and about 45 years ago, carbonless copy paper was developed.

There are generally two types of carbonless copy technology, mechanical transfer type and chemical.

In the mechanical transfer type carbonless paper technology, the undersurface (back side) of a top sheet is coated with a carbon paper like film. Pressure on the top surface (front side) of the top sheet simply transfers the film to the top surface (front side) of a bottom sheet disposed directly below (underlying the top sheet. Many airline tickets employ a mechanical transfer type carbonless technology.

In the chemical type carbonless paper technology, the back surface (back side) of a top sheet of paper (the "original") is coated with a layer of microcapsules that contain a dye in colorless form in a hydrocarbon solvent. The coating on the back side of the top ("original") sheet is usually termed "CB" for carbonless back or coated back. Writing or printing pressure applied to the top surface (front side) of the top sheet breaks the capsules and releases the dye, which reacts with a clay or phenolic resin coating on the top surface (front side) of a second, underlying paper sheet (the "copy") located directly below the original sheet to produce a visible image of the writing or printing applied to the original on the copy. The coating on the front side of the copy sheet is usually termed "CF" for carbonless front or coated front.

More particularly, the National Cash Register Company of Dayton, Ohio, introduced their NCR ("No Carbon Required") paper in 1954. NCR, or pressure-sensitive paper is based on the principle of coating the under surface (back side) of the top sheet of paper ("original") with a dried emulsion of colorless dye held in microcapsules which are ruptured by the force of writing or printing pressure applied to the front side of the sheet. The released dye is reacted with a reagent on the front surface of an underlying copy sheet which changes the dye to a colored (typically violet, blue or black) image of the writing or printing.

In NCR paper, and its progeny, the color forming chemicals held on the undersurface (back side) of the top (first, original) sheet are typically grouped under the nomenclature "CB", standing for "coated back". The reacting materials on the top surface (front side) of the second (copy) sheet are grouped under the nomenclature "CF", standing for "coated front".

A variation of the chemical carbonless copy technology is employed in the making of more than one copy from an original. In making the first copy, the back side of the first, original sheet is coated with CB carbonless treatment, and the front side of the second (first copy) sheet is coated with CF carbonless treatment. Second, and subsequent, copies can be made at the same time by coating the undersurface (back side) of the second (copy) sheet with CB treatment and coating the top surface (front side) of a third (second copy) sheet with CF treatment, and so forth depending upon how many copies are desired to be produced. The pressure of writing or printing on the top surface of the first, original sheet breaks the CB capsules on the undersurface of the first and second sheets, as a result of which their content of color formers (dyes) and solvent is absorbed into the CF coating (e.g., clay) on the front surface of the second and third sheets, where the color formers are converted to a colored (contrasting with the base color of the paper) image either by a change in pH or by oxidation.

A further variation in the use of chemical carbonless copy technology is employed in the making of a carbonless copy, or copies. Herein, the original, first sheet is not coated, and may be plain paper. The front side of the second, underlying copy sheet is coated with a mixture of CB and CF treatments. The mixture is known as "SC", or "Self-Contained" coating. Mechanical pressure applied (by writing) through the first sheet causes the CB capsules on the front side of the second sheet to rupture, releasing their dye to react with the CF material on the front side of the second sheet. Examples of this variation are found in checkbooks wherein a copy of the check is disposed directly underlying the original.

While carbonless paper, such as has been described above, filled a long felt need for replacing carbon paper, there remains a field of usage which has remained unaddressed for the past 45 years, that is the need for producing a copy of both (front and back) sides of an original form or document. Consider for example, a Federal Tax Return (Internal Revenue Service Form 1040). Information is entered by the taxpayer on both (front and back) sides of the form. Typically, the form is filled out by hand (e.g., written in pen), and the taxpayer must expend additional effort in the making of photocopies of both sides of the form. Alternatively, the information on both sides of the form can be manually transcribed onto both sides of another, duplicate form for recordkeeping purposes. Alternatively, carbon paper could be employed, by carefully positioning a duplicate form under the original form as one side is filled out (with the carbon paper in place therebetween), and then repositioning the form for copying under the original form as the other side is filled out (again, with the carbon paper therebetween). Any of these techniques are entirely unsatisfactory, time consuming, and unnecessary in light of the present invention.

DISCLOSURE OF THE INVENTION

It is therefore an object of the present invention to provide a technique for producing a two-sided carbonless copy of information written or printed on both sides of an original sheet (paper), such as a form or document.

It is a further object of the present invention to provide a chemical carbonless copy technique for producing a two-sided carbonless copy of information written or printed on both sides of an original sheet.

It is a further object of the present invention to provide a technique for producing a carbonless copy wherein the original and copy pages are self-aligning.

It is a still further object of the invention to provide a techique for producing a two-sided copy of a computer-type, such as tractor feed form, which has information entered on both sides thereof.

According to the invention, two-sided "copies" are produced from two-sided "originals" using carbonless copy technology.

In one embodiment of the invention, a single sheet of paper is divided into two portions (pages) by a boundary. Carbonless CB treatment is applied to the front and back surfaces of one of the portions ("original" page), and carbonless CF treatment is applied to the front and back surfaces of the other portion ("copy" page). In use, the copy page is folded along the boundary in back-to-back relationship with the original page, and information entered on the front surface of the original page is reproduced on the back surface of the copy page. In further use, the copy page is folded along the boundary in front-to-front relationship with the original page, and information entered on the back surface of the original page is reproduced on the front surface of the copy page.

According to an aspect of the invention, the boundary is perforated to allow for easy folding of the pages during use, and easy separation of the pages after use.

According to a further aspect of the invention, the carbonless CB and CF treatments are applied only to selected areas of the original and copy pages, respectively. Yet further, the selected areas are preferably offset from the front to the back of the original page.

According to a further aspect of the invention, the original and copy pages are formed from the single sheet in a side-by-side orientation, and the boundary runs vertically between the original and copy pages. Alternatively, the original page is formed above the copy page, and the boundary runs horizontally between the original and copy pages.

According to a further aspect of the invention, the pages are provided with selvages, both on their edges and at the boundary therebetween, which may be perforated so that the folded sheet may be fed through tractor feed printers.

According to a further aspect of the invention, the original and copy pages are dissimilarly colored.

In yet another embodiment of the invention, the original page is untreated. The copy page is treated on its front and back surfaces with a self-contained ("SC") mixture of carbonless CB and CF treatments. Further, the SC treatment may be applied only to selected areas of the second, copy page.

In another embodiment of the invention, carbonless CF treatment is applied to both sides of the copy page, and carbonless CB treatment is applied to all but selected areas of both sides of the original page.

In another embodiment of the invention, a form is disclosed for making multiple (two or more) copies of an original. A single sheet of paper is divided by boundaries into three equal size portions (panels) that can be folded along the boundaries so that the panels are aligned one atop the other. Information is entered in a selected untreated area on one side of one of the panels designated as an "original" page, and is reproduced in corresponding selected carbonless copy treatment coated areas on one side of the other panels designated as "copy" pages. The sheet is refolded so that the panels are aligned one atop the other, and information is entered in a selected offset, untreated area of the other side of the original page and is reproduced in corresponding selected SC-treated areas on the other sides of the copy pages.

In one embodiment for making multiple copies, the copy pages are treated in selected areas with carbonless SC treatment.

In another embodiment for making multiple copies, the original and copy pages are treated in selected areas with carbonless CB and CF treatments.

It should be understood that the term "selected area" as used throughout this disclosure refers to any number of selected areas on a surface of a sheet.

It should be understood that the concept of forming multiple pages, i.e. the original page and the copy page (or pages), from a single sheet of paper is a highly advantageous feature of the present invention due to the various orientations that must be assumed in order to produce the two-sided copy (or copies) of both sides of the original. However, the teachings of the present invention are equally applicable to producing a two-sided copy (or copies) of both sides of an original with separate pages.

Other objects, features and advantages of the invention will become apparent in light of the following description thereof.

The carbonless copy paper of this invention reproduces information written or printed on both the front and back surfaces of an "original" page onto the front and back surfaces, respectively, of a "copy" page. The carbonless copy paper is preferably formed of a single sheet of paper having a boundary dividing the sheet into an "original" page and a "copy" page, and the boundary is preferably perforated for easy separation of the original and copy pages. Separate original and copy sheets of paper are also disclosed. In one embodiment, the front and back surfaces of the original page are coated with CB carbonless treatment, and the front and back surfaces of the copy page are coated with CF carbonless treatment. In another embodiment, the carbonless CF and CB treatments are applied only to selected areas of the front and back surfaces of the original and copy pages. In another embodiment, the original page is left uncoated, and the front and back surfaces of the copy page are coated with a self-contained ("SC") mixture of carbonless CB and CF treatments. In another embodiment, the original page is left uncoated, and the SC mixture is applied only to selected areas of the front and back surfaces of the copy page. The original and copy pages may be divided by a vertical or horizontal boundary. Further, the original and copy pages may be provided with selvages having holes for tractor feed mechanisms. In another embodiment, the front and back surfaces of the copy page are coated with carbonless CF treatment, and all but selected areas of the front and back surfaces of the original page are treated with carbonless CB treatment. In another embodiment, multiple copies of the original page are produced. Methods of making one or more two-sided copies of both sides of an original, using carbonless copy technology are disclosed.

BRIEF DESCRIPTION OF THE DRAWINGS

FIG. 1A is a top plan view of the carbonless copy paper of the present invention.

FIG. 1B is a bottom plan view of the carbonless copy paper of FIG. 1A.

FIG. 1C is a cross sectional view of the carbonless copy paper of FIG. 1A taken on section line 1C—1C through FIG. 1A.

FIG. 1D is a perspective view of the carbonless copy paper of FIG. 1A, with the original and copy pages folded in back-to-back relationship.

FIG. 1E is a perspective view of the carbonless copy paper of FIG. 1A, with the original and copy pages folded in front-to-front relationship.

FIG. 1F is a top plan view of an alternate embodiment of the carbonless copy paper of the present invention.

FIG. 1G is a bottom plan view of the carbonless copy paper of FIG. 1F.

FIG. 1H is a cross sectional view of the carbonless copy paper of FIG. 1F.

FIG. 1I is a top plan view of an alternate embodiment of the carbonless copy paper of the present invention.

FIG. 1J is a bottom plan view of the carbonless copy paper of FIG. 1I.

FIG. 1K is a cross sectional view of the carbonless copy paper of FIG. 1I.

FIG. 1L is a top plan view of an alternate embodiment of the carbonless copy paper of the present invention.

FIG. 1M is a bottom plan view of the carbonless copy paper of FIG. 1L.

FIG. 1N is a cross sectional view of the carbonless copy paper of of FIG. 1L.

FIG. 1P is a top plan view of an alternate embodiment of the carbonless copy paper of the present invention.

FIG. 1Q is a bottom plan view of the carbonless copy paper of FIG. 1P.

FIG. 1R is a top plan view of an alternate embodiment of the carbonless copy paper of the present invention.

FIG. 1S is a perspective view of the carbonless copy paper of FIG. 1R.

FIG. 1T is a perspective view of the carbonless copy paper of FIG. 1R.

FIG. 1U is a top plan view of an alternate embodiment of the carbonless copy paper of the present invention.

FIG. 1V is a bottom plan view of the carbonless copy paper of FIG. 1U.

FIG. 1W is a cross sectional view of the carbonless copy paper of FIG. 1U.

FIG. 2A is a top plan view of an alternate embodiment of the carbonless copy paper of the present invention.

FIG. 2B is a bottom plan view of the carbonless copy paper of FIG. 2A.

FIG. 2C is a cross sectional view of the carbonless copy paper of FIG. 2A, taken on section line 2C—2C through FIG. 2A.

FIG. 2D is a perspective view of the carbonless copy paper of FIG. 2A, folded for producing copies of one side of the original page.

FIG. 2E is a perspective view of the carbonless copy paper of FIG. 2A, refolded for producing copies of the other side of the original page.

FIG. 2F is a perspective view of an alternate embodiment of the carbonless copy paper of the present invention.

FIG. 2G is a perspective view of the carbonless copy paper of FIG. 2F.

FIG. 2H is a top plan view of an alternate embodiment of the carbonless copy paper of the present invention.

FIG. 2I is a bottom plan view of the carbonless copy paper of FIG. 2H.

FIG. 2J is a cross sectional view of the carbonless copy paper of FIG. 2H, taken on section line 2J—2J through FIG. 2H.

FIG. 2K is a perspective view of the carbonless copy paper of FIG. 2H.

FIG. 2L is a perspective view of the carbonless copy paper of FIG. 2H.

FIG. 2M is a top plan view of an alternate embodiment of the carbonless copy paper of the present invention.

FIG. 2N is a bottom plan view of the carbonless copy paper of FIG. 2M.

FIG. 2P is a top plan view of an alternate embodiment of the carbonless copy paper of the present invention.

FIG. 2Q is a bottom plan view of the carbonless copy paper of FIG. 2P.

FIG. 2R is a cross sectional view of the carbonless copy paper of FIG. 2P.

DETAILED DESCRIPTION OF THE INVENTION

First Emodiment

Figure 1A:
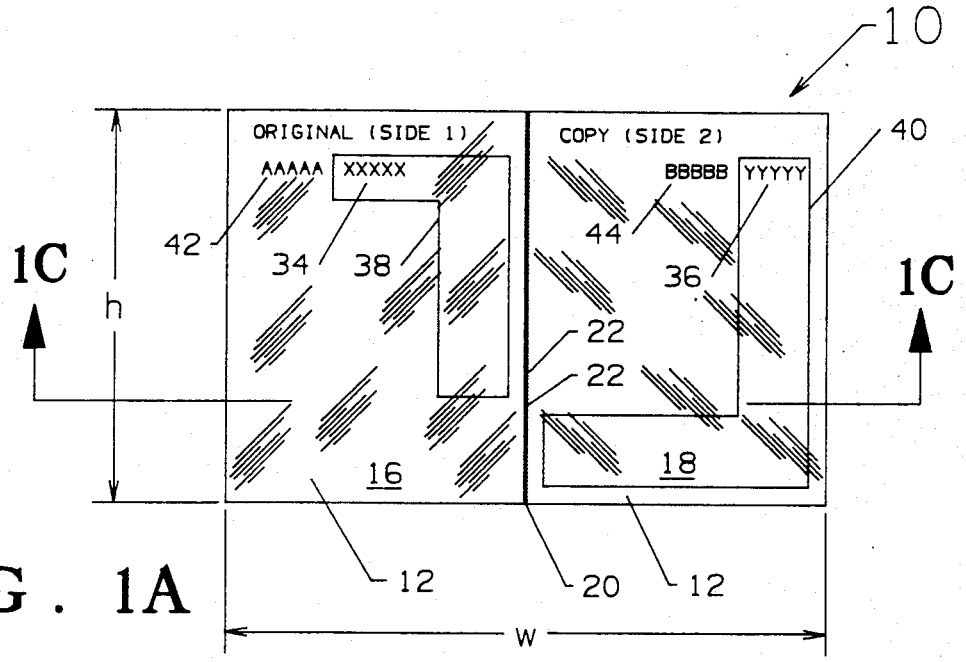
FIGS. 1A-1E

FIG. 1A, 1B, 1C, 1D and 1E show a single sheet of carbonless copy paper 10 according to the present invention. The sheet 10 has a front surface 12 and a back surface 14. By way of example, the height, h, of the sheet is 11 inches, and the overall width, w, of the sheet is 17 inches. The sheet is divided into two side-by-side portions of equal width (e.g., 8½ inches each), a left portion 16 and a right portion 18. The left and right portions 16 and 18 are divided by a boundary 20, which is perforated by a line of perforations 22 to facilitate folding the left and right portions with respect to one another, and to facilitate separation of the left portion from the right portion, as discussed hereinafter. The sheet 10 thus forms two pages; an "original" two-sided page 16 and a "copy" two-sided page 18.

As best viewed in FIG. 1A, the front surface 12 of the left portion 16 bears a legend "ORIGINAL (SIDE 1)", and the front surface 12 of the right portion 18 bears a legend "COPY (SIDE 2)".

Figure 1B:
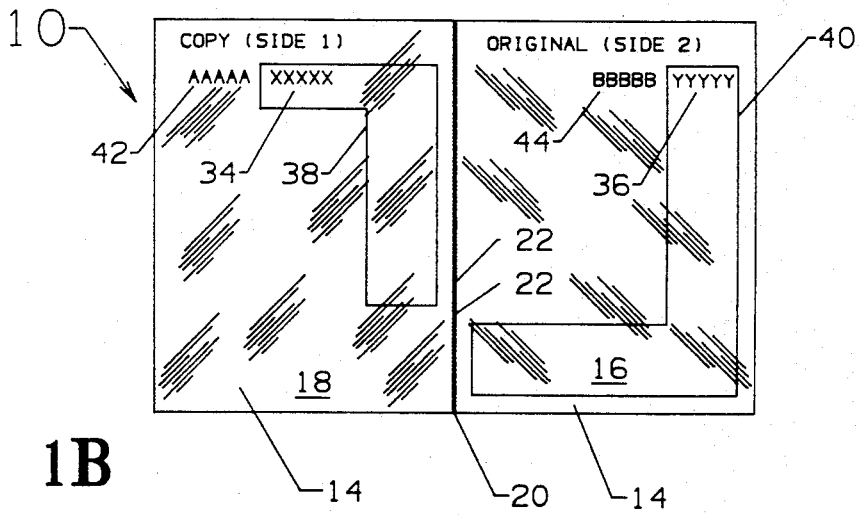

As best viewed in FIG. 1B, the back surface 14 of the left portion 16 bears legend "ORIGINAL (SIDE 2)", and the back surface 14 of the right portion 18 bears a legend "COPY (SIDE 1)". No particular meaning is intended to be ascribed to these legends other than that they are useful in understanding the invention.

Figure 1C:
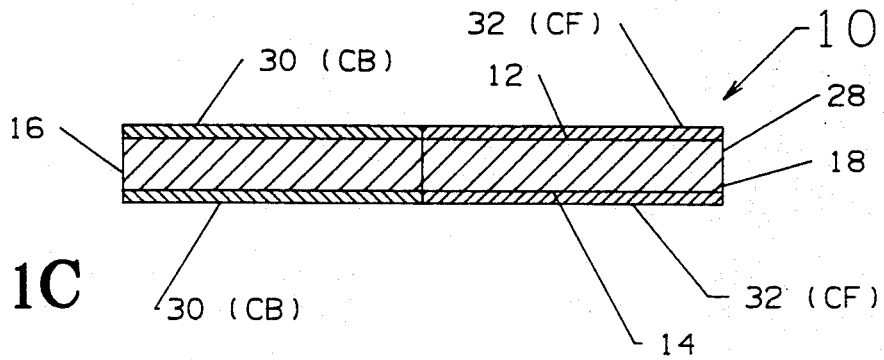

As best viewed in FIG. 1C, the sheet 10 of carbonless copy paper is formed of a base sheet of ordinary paper 28 to which a carbonless CB coating 30 and carbonless CF coating 32 are applied, in the following manner. The front and back surfaces 12 and 14 of the left portion 16 are coated with one part 30 (CB) of a two-part, chemical carbonless copy treatment, and the front and back surfaces 12 and 14 of the right portion 18 are coated with another, cooperating part 32 (CF) of the two-part, chemical carbonless copy treatment. Generally, the entire front and back surfaces of the left and right portions are coated with CB and CF carbonless copy treatment, respectively, as shown in FIG. 1C, but application of the carbonless copy treatment to selected areas of the front and back surfaces of the left and right portions is also useful and is discussed hereinafter. Suitable carbonless CB and CF treatments are generally well known, and are discussed hereinafter.

Although not shown, it will become evident that the carbonless CB and CF treatments may not extend fully to the periphery of each of the original and copy pages, respectively. More particularly, they may stop short, such as by one-tenth of an inch, of the boundary where the pages will be folded, as described hereinafter.

Further, it must be appreciated, throughout the various embodiments of the invention disclosed herein, that although the delineation of the single sheet of paper into original and copy pages is a highly beneficial feature of the invention, insofar as folding the original and copy pages into various orientations is concerned (as discussed hereinafter), the invention is applicable to producing two-sided copies of both sides of an original using separate sheets of paper.

Figure 1D:
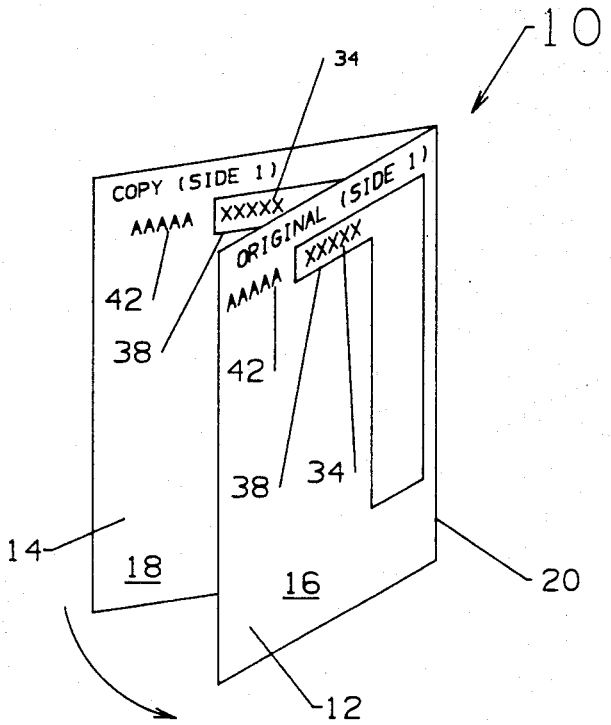

In use, first information 34 ("XXXXX") is printed or written (entered), such as by pen, pencil or impact printer, on the front surface 12 (Side 1) of the original page 16 (see FIG. 1A), and is reproduced on the back surface 14 (Side 1) of the copy page 18 (see FIG. 1B). In order to effect this result, prior to entering the first information 34 on the front surface 12 (Side 1) of the original page 16, the copy page 18 is folded along the boundary 20 underneath, back-to-back, and in alignment with the original page 16, as shown in FIG. 1D. The carbonless CB treatment 30 on the back surface 14 (Side 2) of the original page 16 reacts with the carbonless CF treatment 32 on the back surface 14 (Side 1) of the copy page 18 to create the reproduction of the first information 34 on the back surface 14 (Side 1) of the copy page 18. FIG. 1D shows the copy page 18 partially folded beneath the original page 16, in back-to-back relationship therewith.

Figure 1E:
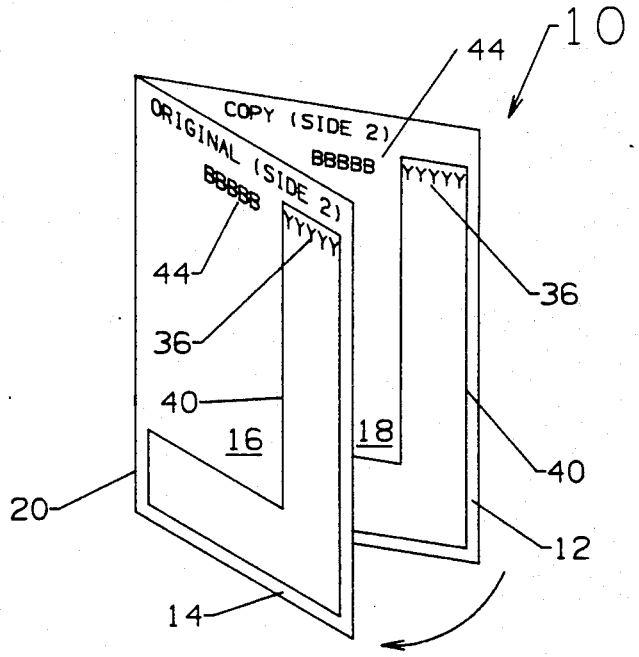

In further use, second information 36 ("YYYYY") is printed or written (entered) on the back surface 14 (Side 2) of the original page 16 (see FIG. 1B), and is reproduced on the front surface 12 (Side 2) of the copy page 18 (see FIG. 1A). In order to effect this result, prior to entering the second information 36 on the back surface 14 (Side 2) of the original page 16, the copy page 18 is folded along the boundary 20 on top of, front-to-front and in alignment with the original page 16, as shown in FIG. 1E. The carbonless CB treatment 30 on the front surface 12 (Side 1) of the original page 16 reacts with the carbonless CF treatment 32 on the front surface (Side 2) 12 of the copy page 18 to create a reproduction of the second information 36 on the front surface 12 (Side 2) of the copy page 18. FIG. 1E shows the copy page 18 partially folded atop the original page 16, in front-to-front relationship therewith.

After the first information 34 has been entered on the front surface 12 (Side 1) of the original page 16 and reproduced on the back surface 14 (Side 1) of the copy page 18, and after the second information 36 has been entered on the back surface 14 (Side 2) of the original page 16 and reproduced on the front surface 12 (Side 2) of the copy page 18, the original and copy pages 16 and 18 may be separated by tearing the sheet 10 along the boundary perforations 22. In this manner, a two-sided copy 18 of a two sided original 16 is produced. This is of particular interest in filling out two-sided forms, such as Federal Income Tax Form 1040.

An unusual feature of the present invention, as described with respect to FIGS. 1A through 1E, is that information is entered on a surface of the sheet that has a carbonless copy treatment. Consider the following. When entering the first information 34 ("XXXXX") on the front surface 12 (Side 1) of the original page 16, although it is the carbonless CB treatment 30 on the back surface of the original page 16 that is "operative" in the sense that it reacts with the carbonless CF treatment 32 on the back surface 14 (Side 1) of the copy sheet 18, nevertheless the information to be copied is entered on the front, treated surface 12 of the original page 16. Hence, in the case of the entire front surface 12 of the original page 16 being treated with the carbonless treatment (for reproduction by the back surface 14 thereof), the microencapsulated dye of the carbonless CB treatment 30 on the front surface 12 of the original page 16 may be released. However, it is released without any visible result. Remember, copying (reproduction of information) is only effected when the microencapsulated dye of the carbonless CB treatment 30 on the back surface 14 of the original page 16 reacts with the carbonless CF treatment on the back surface 14 of the copy page 18 which is in intimate, back-to-back contact therewith (when folded thereunder). Hence, the microencapsulated dye of the carbonless CB treatment 30 on the front surface 12 of the original page 16 which is released when entering the first information 34 ("XXXXX") on the front surface 12 (Side 1) of the original page 16 is simply superfluous, and may, at worst, tend to clog the tip of a ball point pen used to enter the first information. Hence. a ball point pen having a nonclogging tip is recommended for entering information, if a ball point pen is the writing instrument of choice. Such a clogging tendency would not be apparent if a pencil were employed for entering the information. A similar situation occurs when entering the second information 36 ("YYYYY") on the back surface 14 (Side 2) of the original page 16. Superfluous microencapsulated dye may be released from the carbonless CB treatment 30 on the back surface 14 of the original page, but would be released without visible effect. More importantly, microencapsulated dye will be released from the carbonless CB treatment 30 on the front surface 12 of the original page 16 onto the front surface 12 (Side 2) of the copy page 18 (folded in front-to-front relationship with the original page 16) to produce a copy of the second information on the front surface 12 (Side 2) of the copy page 18.

In the context of filling out preprinted, two-sided forms, information is typically entered in selected areas on each side of the form. As shown in FIG. 1A, a selected area for entering the first information 34 ("XXXXX") on the front surface 12 (Side 1) of the original page 16 is delineated by a preprinted border 38. As shown in FIG. 1B, a selected area for entering the second information 36 ("YYYYY") on the back surface 14 (Side 2) of the original page 16 is delineated by a preprinted border 40. Preferably, as shown, the borders 38 and 40 are preprinted on the copy page 18 so that the copy page 18 will be an exact duplicate of the original page 16. It should be understood that the selected areas for entering the first and second information may be delineated by means other than preprinted borders. Such means would include delineating such areas by differential shading (from the remainder of the page). Federal Income Tax Form 1040 is a good example of such differential shading. Therein, selected areas for entering information are white (the base color of the paper), and the areas where information is not entered (containing preprinted, instructional information) are colored blue.

In further connection with the entering of the first and second information 34 and 36 on the front and back surfaces 12 and 14, respectively, of the original page 16, other matter (other than the preprinted borders 38 and 40) may be preprinted on the original and copy pages 16 and 18. For example, first instructional information 42 ("AAAAA") is preprinted on the front surface 12 (Side of the original page 16 in juxtaposition with the preprinted border 38, and second instructional information 44 ("BBBBB") is preprinted on the back surface 14 (Side 2) of the original page 16 in juxtaposition with the preprinted border 40. Preferably, as shown, the instructional information 42 and 44 is preprinted on the copy page 18 so that the copy page 18 will be an exact duplicate of the original page 16. In the context of forms, such as the aforementioned Federal Income Tax Form 1040, the instructional information 42 and 44 directs the taxpayer to enter particular information 34 and 36 in the respectively juxtaposed selected areas delineated by the borders 38 and 40.

The concept of delineating areas for entering information on the original page, and juxtaposing preprinted instructional information therewith, is pervasive throughout the descriptions of the various embodiments of the invention, and is intended not only as a useful feature, but also is intended to assist in understanding the various descriptions.

Preferably, for ease of discriminating between the original and copy pages, throughout the various embodiments described herein, the original page and copy pages are dissimilarly colored. Typically, the original page is not colored at all and is left white, and the copy page is colored pink, buff, canary or another color contrasting with white. In the context of creating multiple (more than one) copies, as described hereinafter, each of the copies could be dissimilarly colored—one pink, one canary, etc. Such dissimilar coloration of copy pages is well known, and can be applied as a foundation (base) coloring in the paper itself, or could be a dye mixed in with the carbonless copy treatment. The original page 16 can also have a non-white base color, such as blue, as in the case of Federal Income Tax Form 1040, wherein the areas for entering information are left white, uncolored.

The chemistry of chemical carbonless copy technology, preprinting instructional information on forms, providing differential base coloring on the paper and perforating the paper are all well known, and are advantageously employed in the present invention. Throughout the descriptions of the various embodiments of this invention, it should be understood that any suitable CB and CF, or SC (described hereinafter) coatings could be employed.

The utility of this invention in the context of creating a copy of a two-sided form is manifestly evident. For instance, it would no longer be necessary to obtain a photocopy of a two-sided form in order to retain a copy thereof. Nor would it be necessary to manually reproduce on a copy (typically a separate, second original) of the form the information entered on the original. Nor would it be necessary to carefully position carbon paper between two copies (one original and one copy) of a form. One of the extraordinary benefits of the present invention is that the copy page (18) is self-aligning with the original page (16) since it is well retained in alignment therewith by the "living hinge" formed by folding the copy page under and over the original page (as described above).

The utility of this invention extends beyond creating a two-sided copy of both sides of a form. It has utility in reproducing information entered on both sides of any (original) page. This would include invoices and the like, which contain lin.ited preprinted information, as well as completely blank (with no preprinted markings or information) original pages, such as letter stationary. Warranty cards, subscription renewal forms and the like would all benefit from the teachings of the present invention. Carbonless copy treatment is known to be effective on paper up to 45 pounds (card stock).

A further benefit of the present invention is that the copy page is "self-aligning" with the original page, when they are formed from a single sheet of paper. This has utility beyond the making of a two-sided copy of both sides of an original. Consider, for instance the making of a single-sided copy of one side of an original. With reference to FIGS. 1A–1E, only the back surface 14 of the original page 16 would be coated with carbonless CB treatment, and only the back surface 14 of the copy page 18 would be coated with carbonless CF treatment. While this would only be useful for producing a one-sided copy of the front side of the original, the original and copy pages would be self-aligning. In other words, when the copy page is folded under the original page in back-to-back relationship therewith, the pages, legends and markings would be perfectly aligned.

As described in the aforementioned U.S. patent application Ser. No. 334,183, of which this application is a continuation-in-part, the carbonless copy paper of this invention is of particular utility in connection with a booklet. Therein is described a very long strip of paper "accordion" folded into several original and several copy "pages" for entering various information. Information is entered on both sides (front and back surfaces) of the original pages, and is reproduced on both sides (front and back surfaces) of the copy pages. The terminology "male" and "female" carbonless treatments was used to describe carbonless CB and CF treatments, respectively. The use of carbonless SC treatment is suggested therein. It is apparent that many, many uses will be developed for the carbonless paper technology of the present invention.

It should be understood that, although the original and copy pages have been described as being formed from a single sheet of paper, the technology disclosed herein is applicable, for instance, to two individual sheets of paper—one coated (including patterned coatings, discussed hereinafter) on its front and back surfaces with carbonless CB treatment, and the other coated on its front and back surfaces with carbonless CF treatment. The hinge effect of the single sheet with perforated border 20 is, however, much more convenient in terms of ensuring that an original page is mated with a copy page and kept in alignment therewith during the entering of information.

Alternate Embodiment—Treating Selected Areas

While the superfluous release of microencapsulated dye from the carbonless treatment from the "wrong" (written upon) surface of the original page has been found not to present any obstacle to the entering of information on either side of the original page and subsequent reproduction of the information on the copy page, it may be advantageous to select particular areas on the front and back surfaces of the original page in which the first and second information is to be entered, and to offset these selected areas so that they are not aligned front-to-back on the original page, and to apply the carbonless CB treatment only to corrresponding selected areas on the opposite sides of the original page, in front-to-back alignment therewith. Among other advantages of such a "patterned" application of the carbonless treatment, this would avoid any potential pen-clogging problem.

Figure 1F:
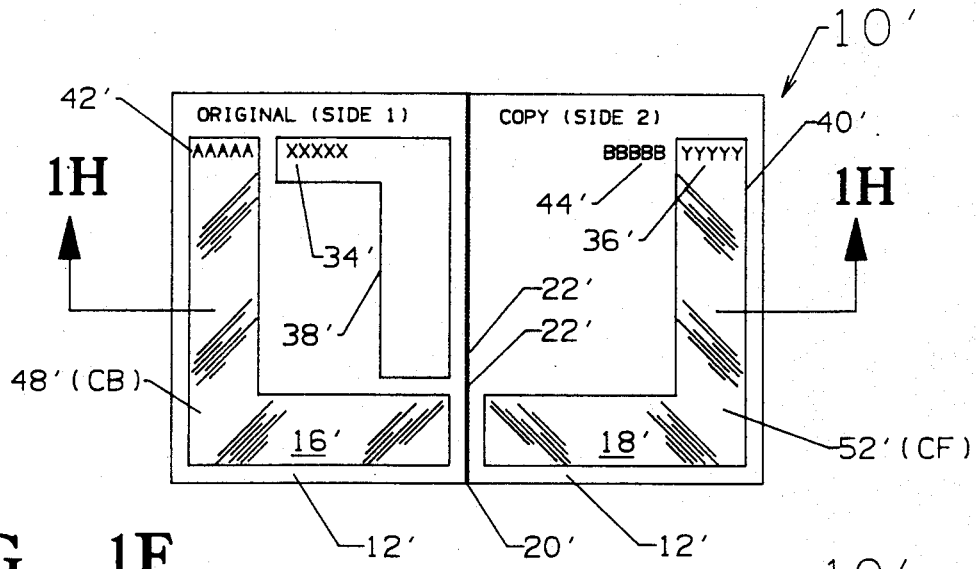
FIGS. 1F-1H
Figure 1G:
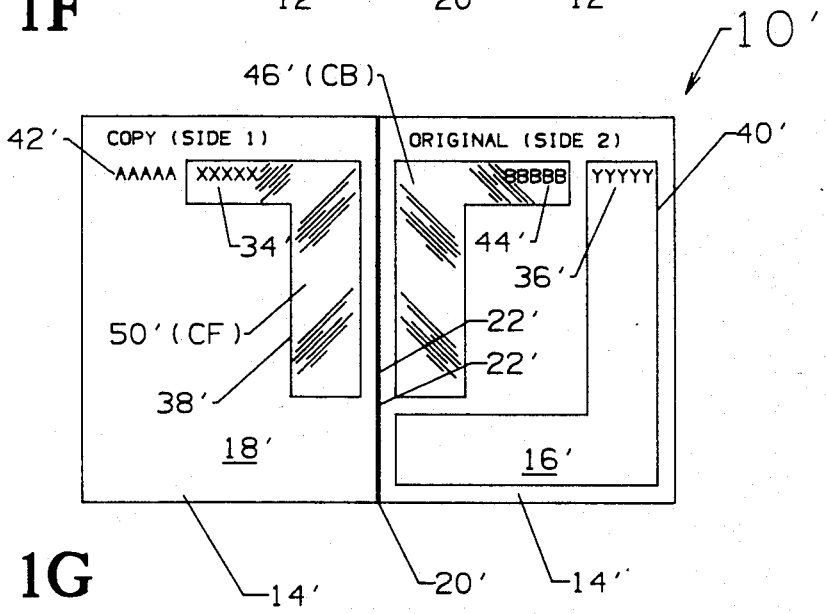
Figure 1H:
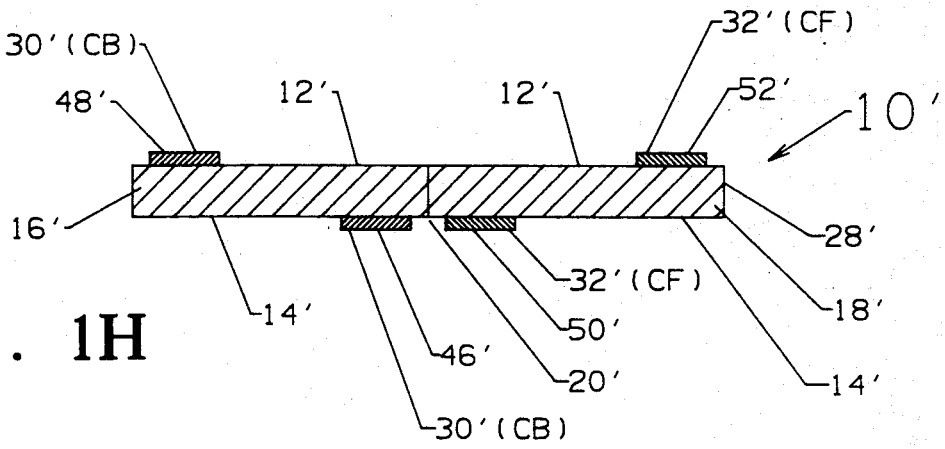

FIGS. 1F, 1G and 1H are similar to FIGS. 1A, 1B and 1C, and show an alternate embodiment of the invention. A single sheet 10', having a front surface 12' and a back surface 14', is divided by a boundary 20', having perforations 22', into an original page 16' and a copy page 18'.

As shown in FIGS. 1F, 1G and 1H, a selected area 38' (not necessarily including a preprinted border) on the front surface 12' of the original page 16' is delineated for entering first information 34' ("XXXXX"). A selected area 40' on the back surface 14' of the original page 16' is delineated for entering second information 36' ("YYYYY"). The first and second selected areas are offset, not in front-to-back alignment with each other. As in the previous embodiment, legends 42' and 44' are juxtaposed with the selected areas 38' and 40', respectively, and the delineated areas 38' and 40' and the legends 42' and 44' are repeated on the copy page 18'.

The carbonless CB treatment 30' is applied to the original page 16', as follows. Carbonless CB treatment 30' is applied to a selected area 46' on the back surface 14' of the original page 16' in front-to-back alignment with the selected area 38' for entering the first information 34' ("XXXXX") on the front surface 12' of the original page 16'. Further, carbonless CB treatment 30' is applied to a selected area 48' on the front surface 12' of the original page 16' in front-to-back alignment with the selected area 40' for entering the second information 36' ("YYYYY") on the back surface 14' of the original page 16'. Notably, the selected, CB coated area 48' on the front surface 12' of the original page 16' does not overlap the selected area 38' for entering the first information 34' ("XXXXX") on the front surface 12' of the original page 16'. Similarly, the selected, CB coated area 46' on the back surface 14' of the original page 16' does not overlap the selected area 40' for entering the second information 36' ("YYYYY") on the back surface 14' of the original page 16'. The non-overlapping of the selected areas coated with carbonless CB treatment 30' with the selected areas for entering information on either side of the original page absolutely prevents any pen skipping or clogging problems, since it is not necessary to write upon the carbonless CB coating as in the embodiment of FIGS. 1A-1C.

The copy page 18' can be completely coated with carbonless CF coating 32', as it was in the embodiment of FIGS. 1A-1C, but it is preferably applied as follows. Carbonless CF treatment 32' is applied to a selected area 50' on the back surface 14' of the copy page 18' in front-to-back alignment with the selected area 38' for reproducing the first information 34' ("XXXXX") entered on the front surface 12' of the original page 16'. Further, carbonless CF treatment 32' is applied to a selected area 52' on the front surface 12' of the copy page 18' in front-to-back alignment with the selected area 40' for reproducing the second information 36' ("YYYYY") entered on the back surface 14' of the original page 16'.

In order to effect reproduction of the first information 34' ("XXXXX") entered on the front side 12' of the original page 16' onto the back side 14' of the copy page 18', the copy page 18' is folded under the original page 16', in back-to-back relationship therewith, as described with respect to FIG. 1D.

Similarly, in order to effect reproduction of the second information 36' ("YYYYY") entered on the back side 14' of the original page 16' onto the front surface 12' of the copy page 18', the copy page 18' is folded the opposite way, in front-to-front relationship with the original page 16', as described with respect to FIG. 1E.

The selective application of carbonless CB and CF copy treatments only to selected areas of a sheet of paper is well known, and is usually termed "patterning".

Again, separate original and copy sheets can be provided, but the formation of original and copy pages from a single sheet of paper is advantageously self aligning.

Throughout the various embodiments described herein, it should be appreciated that the carbonless coatings have been enormously exaggerated for illustrative purposes.

Alternate Embodiment—SC Coating On Copy Page

Figure 1I:
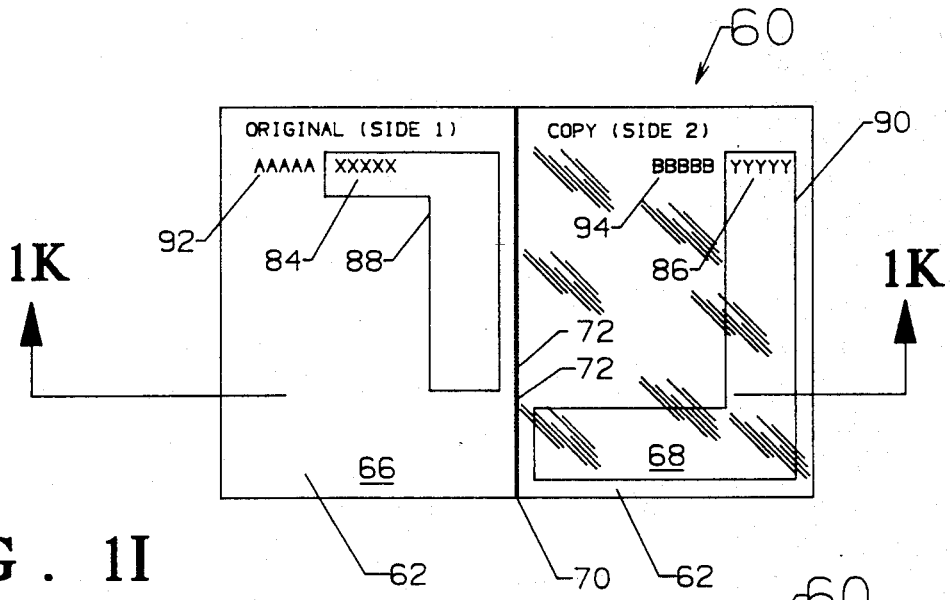
FIGS. 1I-1K
Figure 1J:
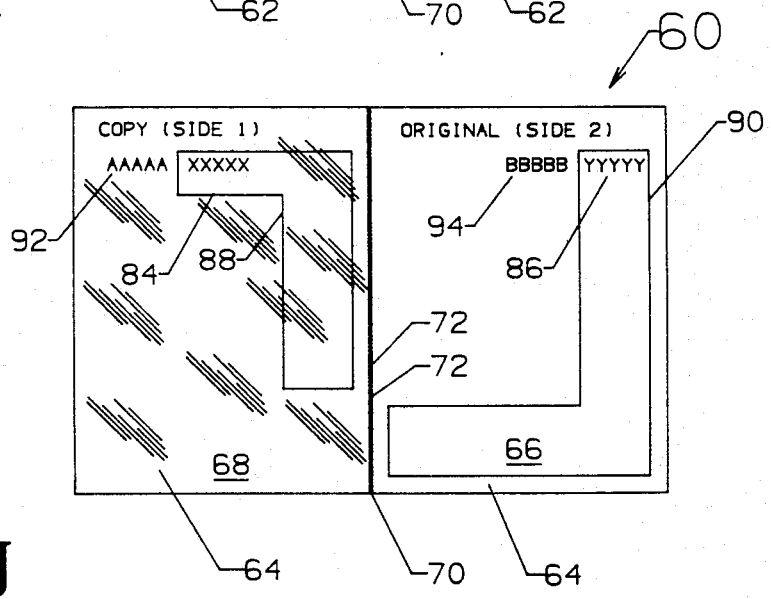
Figure 1K:
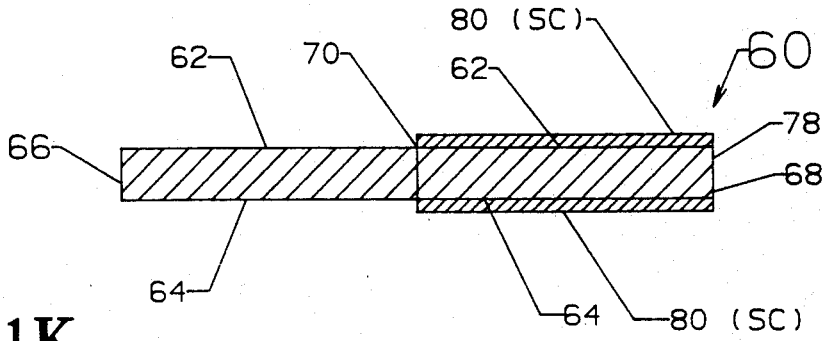

FIGS. 1I, 1J and 1K show an alternate embodiment of the invention, involving a chemical carbonless treatment such as has been discussed, with one important distinction. Whereas in the previous embodiments, carbonless CB treatment was applied to the front and back surfaces of one (original) sheet and carbonless CF treatment was applied to the front and back surfaces of the other (copy) sheet, in the present embodiment information is effectively reproduced from plain, untreated paper onto paper having a mixture of CB (microencapsulated dye) and CF (reactive clay, or the like) treatments. Such a mixture is well known, and is employed for instance on the "stub" of self-reproducing checks. As used herein, the mixture of CB and CF coatings together is referred to as "SC", or Self-Contained coating. This is to be distinguished from some manufacturers "CBF" coated paper which has a CF coating on one side thereof for reproducing information (from a page having CB coating) and CB coating on the other side thereof for transferring information to a subsequent copy page (having CF coating).

FIGS. 1I, 1J and 1K are similar to FIGS. 1A, 1B and 1C, and show an alternate embodiment of the invention. A single sheet 60, having a front surface 62 and a back surface 64, is divided by a boundary 70, having perforations 72, into an original page 66 and a copy page 68.

As shown in FIGS. 1I, 1J and 1K, a selected area 88 (not necessarily including a preprinted border) on the front surface 62 of the original page 66 is delineated for entering first information 84 ("XXXXX"). A selected area 90 on the back surface 64 of the original page 66 is delineated for entering second information 86 ("YYYYY"). The first and second selected areas are offset, not in front-to-back alignment with each other. As in the previous embodiment, legends 92 and 94 are juxtaposed with the selected areas 88 and 90, respectively, on the original page 66, and the delineated areas 88 and 90 and the legends 92 and 94 are repeated on the copy page 68.

The notable difference between the embodiment of FIGS. 1I, 1J and 1K and the previously described embodiments is that the original page 66 is not coated with a carbonless coating, but is simply left uncoated, as plain paper. The fact that the original page 66 is not coated with a carbonless coating absolutely avoids any pen skipping or clogging problems, since it is not necessary to write upon the carbonless CB coating as in the embodiment of FIGS. 1A-1C. Further, potential allergic reactions resulting from skin contact with a carbonless coating, while writing, are avoided since the original page is not coated with a carbonless copy treatment.

The copy page 68 is coated with a mixture of carbonless CB and CF coatings, termed "SC" or Self-Contained coating. The SC carbonless treatment is shown in FIG. 1K as a coating 80 applied to the sheet of paper 78. Any suitable SC coating is effectively employed, and such coatings are well known.

In order to effect reproduction of the first information 84 ("XXXXX") entered on the front side 62 of the original page 66 onto the back side 64 of the copy page 68, the copy page 68 is folded under the original page 66, in back-to-back relationship therewith, as described with respect to FIG. 1D.

Similarly, in order to effect reproduction of the second information 86 ("YYYYY") entered on the back side 64 of the original page 66 onto the front surface 62 of the copy page 68, the copy page 68 is folded the opposite way, in front-to-front relationship with the original page 66, as described with respect to FIG. 1E.

Again, separate original and copy sheets can be provided, but the formation of original and copy pages from a single sheet of paper is advantageously self-aligning.

Alternate Embodiment—Patterned SC Coating

While the use of self-contained carbonless SC coating on the copy page and no coating on the original page solves any potential problems of pen clogging or allergic reaction that may have manifested themselves as a result of the carbonless CB treatment on the original page, it may be nevertheless be advantageous to apply the carbonless SC coating only to selected areas on the front and back surfaces of the copy page, and to offset these selected areas so that they are not aligned front-to-back on the copy page. For instance, this should result in diminished usage of the carbonless SC material on the copy page, and hence should lower the cost of production.

Figure 1L:
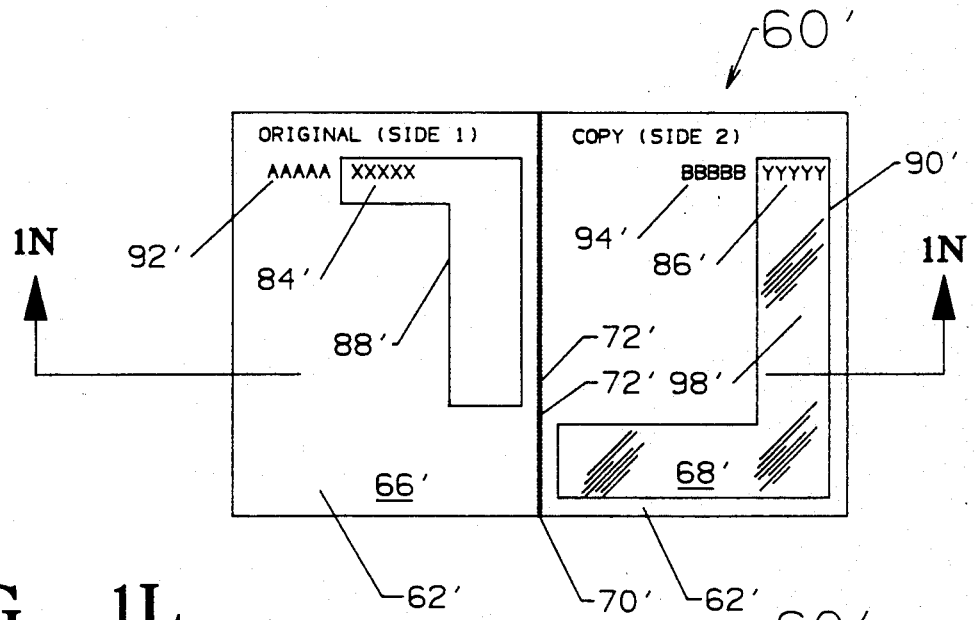
FIGS. 1L-1N
Figure 1M:
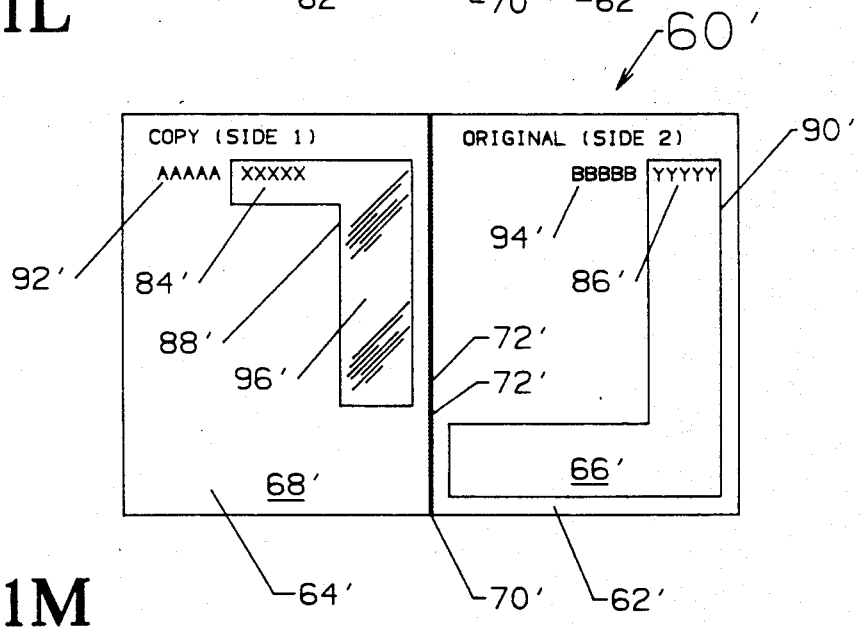
Figure 1N:
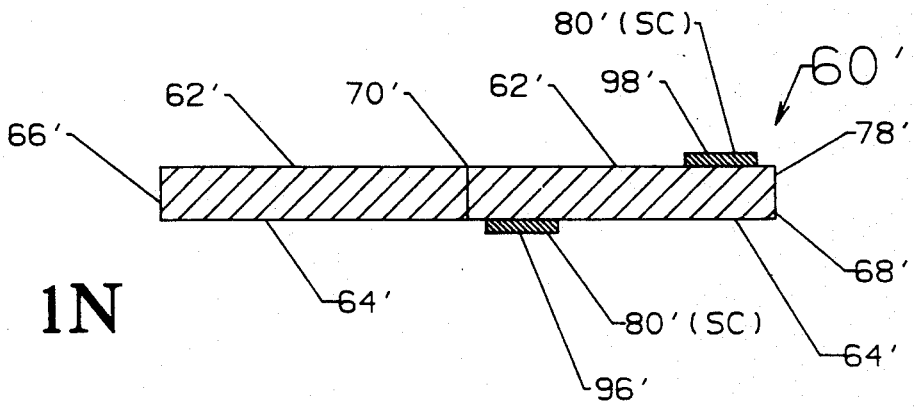

FIGS. 1L, 1M and 1N show an alternate embodiment of the carbonless copy paper of FIG. 1I. Whereas in the previous embodiment (FIGS. 1I-1K) the entire front and back surfaces 62 and 64 of the copy page 68 were coated with the carbonless SC treatment (Self-Contained mixture of carbonless CB and CF treatments), in the embodiment of FIGS. 1L-1M the carbonless SC treatment is applied only to selected areas on the front and back surfaces of the copy page. This will result in diminished usage of the carbonless SC material, and hence should result in lower cost.

FIGS. 1L, 1M and 1N are similar to FIGS. 1I, 1J and 1K, and show an alternate embodiment of the invention. A single sheet of paper 60', having a front surface 62' and a back surface 64', is divided by a boundary 70', having perforations 72', into an original page 66' and a copy page 68'.

As shown in FIGS. 1L, 1M and 1N, a selected area 88' (not necessarily including a preprinted border) on the front surface 62' of the original page 66' is delineated for entering first information 84' ("XXXXX"). A selected area 90' on the back surface 64' of the original page 66' is delineated for entering second information 86' ("YYYYY"). The first and second selected areas are offset, not in front-to-back alignment with each other. As in the previous embodiment, legends 92' and 94' are juxtaposed with the selected areas 88' and 90', respectively, on the original page 66' and the delineated areas 88' and 90' and the legends 92' and 94' are repeated on the copy page 68'.

Carbonless SC treatment 80' is applied to a selected area 96' on the back surface 64' of the copy page 68' in front-to-back alignment with the selected area 88' for reproducing the first information 84' ("XXXXX") entered on the front surface 62' of the original page 66'. Further, carbonless SC treatment 80' is applied to a selected area 98' on the front surface 62' of the copy page 68' in front-to-back alignment with the selected area 90' for reproducing the second information 86' ("YYYYY") entered on the back surface 64' of the original page 66'.

In order to effect reproduction of the first information 84' ("XXXXX") entered on the front side 62' of the original page 66' onto the back side 64' of the copy page 68', the copy page 68' is folded under the original page 66', in back-to-back relationship therewith, as described with respect to FIG. 1D.

Similarly, in order to effect reproduction of the second information 86' ("YYYYY") entered on the back side 64' of the original page 66' onto the front surface 62' of the copy page 68', the copy page 68' is folded the opposite way, in front-to-front relationship with the original page 66', as described with respect to FIG. 1E.

The selective application of carbonless SC copy treatment only to selected areas of a sheet of paper is well known, and is usually termed "patterning".

Again, separate original and copy sheets can be provided, but the formation of original and copy pages from a single sheet of paper is advantageously self-aligning.

Alternate Embodiment—Horizontal Boundary

Figure 1P:
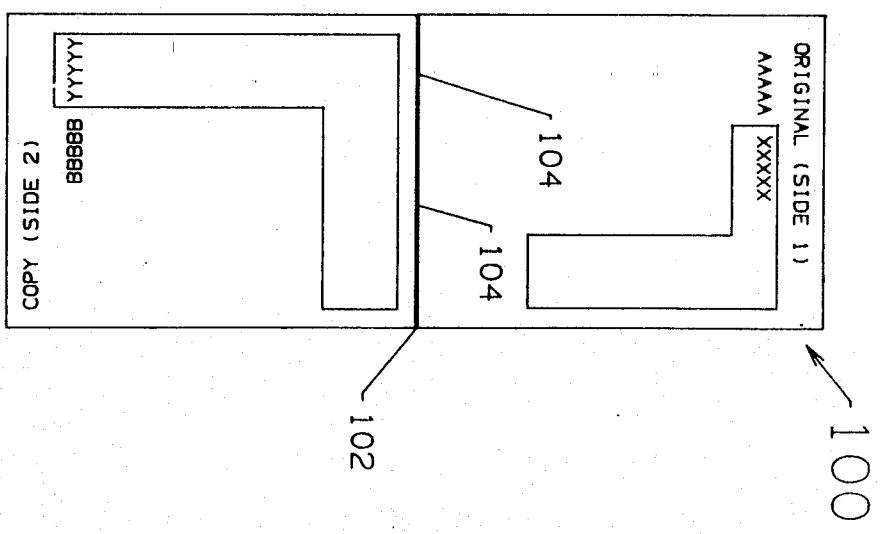
FIGS. 1P-1Q
Figure 1Q:
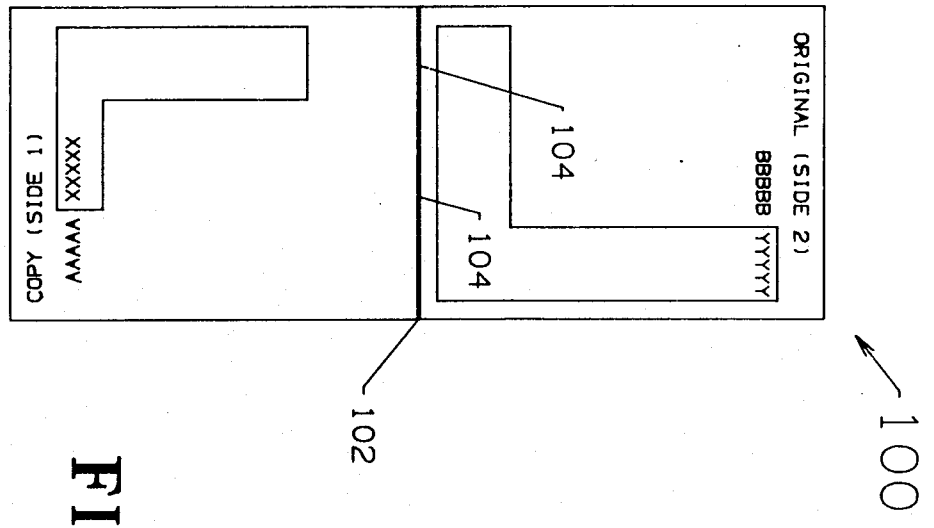

FIGS. 1P and 1Q show an alternate embodiment of the various embodiments of the invention previously described. Generally, the various elements shown herein are identical to those discussed with respect to FIGS. 1A-1E, 1F-1H 1I-1K and 1L-1M, with the exception that the original page (16 or 16' or 66 or 66') is disposed above the copy page (18 or 18' or 68 or 68'), and the original and copy pages are divided by a horizontal border 102 having perforations 104. With respect to the various other features of the original page and copy page, the embodiment of FIG. 1P and 1Q is identical to that of the embodiments shown in FIGS. 1A-1E, 1F-1H, 1I-1K and 1L-1M. In other words, the single sheet of carbonless copy paper has a front surface and a back surface, and is divided by the boundary 102 into an original page and a copy page. With respect to the embodiments described in FIGS. 1A-1E, the front and back surfaces of the original page are coated with carbonless CB treatment, and the front and back surfaces of the copy page are coated with carbonless CF treatment. With respect to the embodiment described in FIGS. 1F-1H, only selected areas of the front and back surfaces of the original page are coated with carbonless CB treatment, and preferably only selected areas of the front and back surfaces of the copy page are coated with carbonless CF treatment. With respect to the embodiment described in FIGS. 1I-1K, the original page is plain paper, and the copy page is coated with carbonless SC treatment. With respect to the embodiment described in FIGS. 1L-1M, the original page is plain paper and only selected areas of the copy page are coated with the carbonless SC treatment.

The copy page is folded (vertically, rather than horizontally) under the original page, in back-to-back relationship therewith, to effect reproduction on the back surface of the copy page of information entered on the front surface of the original page. Subsequently, the copy page is folded over the original page, in front-to-front relationship therewith, to effect reproduction on the front surface of the copy page of information entered on the back surface of the original page.

Again, separate original and copy sheets can be provided, but the formation of original and copy pages from a single sheet of paper is advantageously self-aligning.

Alternate Embodiment—Tractor Feed

Figure 1T:
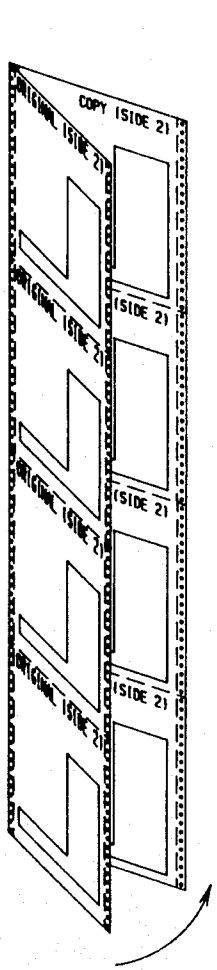
FIGS. 1R-1T
Figure 1S:
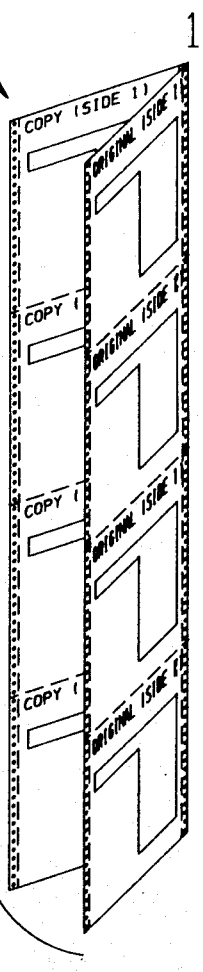
Figure 1R:
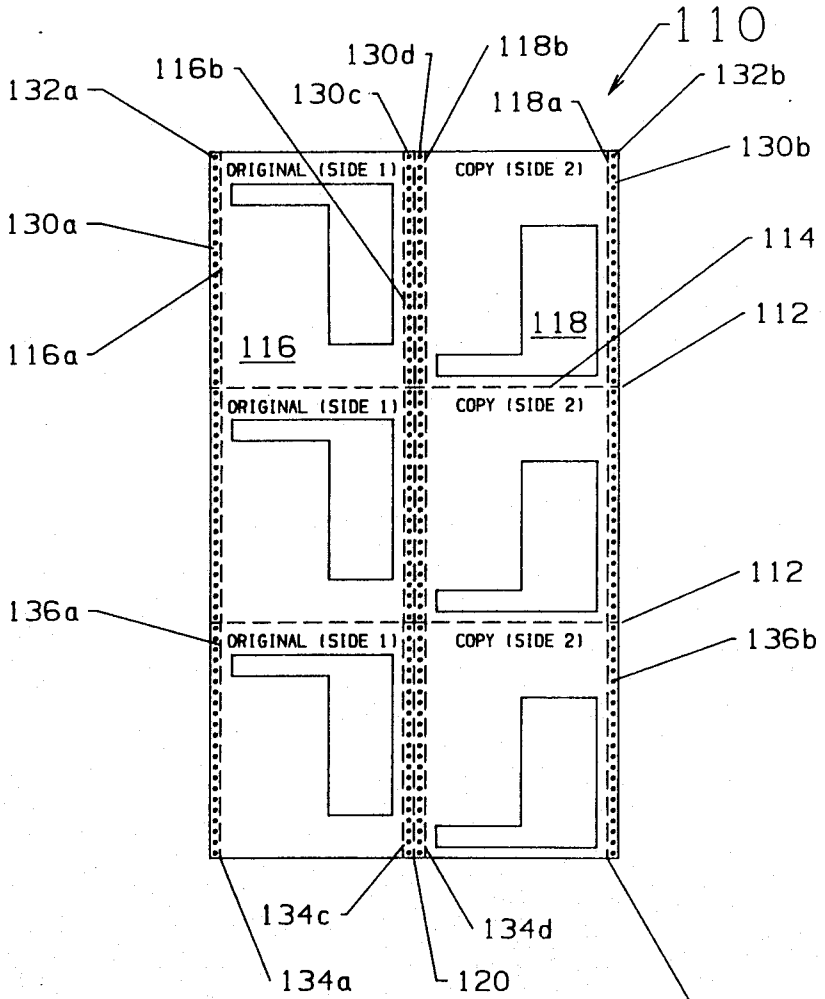

FIGS. 1R, 1S and 1T show an alternate embodiment of the invention. Generally, the various elements shown herein are identical to those discussed with respect to FIGS. 1A-1E, 1F-1H 1I-1K and 1L-1M, and the original page 116 (corresponding to 16 or 16' or 66 or 66') and the copy page 118 (corresponding to 18 or 18' or 68 or 68') are preferably divided by a vertical border 120 (corresponding to the borders 20, 20', 70 and 70') having perforations 122 (corresponding to the perforations 22, 22', 72 and 72') for folding and separating the original and copy pages. In this embodiment, the original and copy pages 116 and 118 are provided with selvages along their edges for feeding the paper through a tractor feed type printer. Further, the sheet of paper 110 forms a series of pairs of original pages 116 and copy pages 118, separable along lines 112 of perforations 114.

As best viewed in FIG. 1R, the left, outer edge 116*a* of the original page 116 is provided with a selvage 130*a* having holes 132*a* suitable for use with a tractor feed mechanism such as is commonly found in computer printers. A line 134*a* of perforations 136*a* is provided for separating the selvage 130*a* from the original page (after printing).

Similarly, the right, outer edge 118*a* of the copy page 118 is provided with a selvage 130*b* having holes 132*b* suitable for use with a tractor feed mechanism such as is commonly found in computer printers. A line 134*b* of perforations 136*b* is provided for separating the selvage 130*b* from the copy page (after printing).

The right, inner edge 116*b* of the original page 116 is provided with a selvage 130*c* having holes 132*c* suitable for use with a tractor feed mechanism such as is commonly found in computer printers. A line 134*c* of perforations 136*c* is provided for separating the selvage 130*c* from the original page (after printing).

Similarly, the left, inner edge 118*b* of the copy page 118 is provided with a selvage 130*d* having holes 132*d* suitable for use with a tractor feed mechanism. A line 134*d* of perforations 136*d* is provided for separating the selvage 130*d* from the copy page (after printing).

As shown in FIG. 1S, when the copy page 118 is folded in back-to-back relationship with the original page 116, for reproducing on the back of the copy page information entered (printed) on the front of the original page, the selvages 130*a* and 130*b* are aligned, as are the holes 132*a* and 132*b* in these selvages.

As shown in FIG. 1T, when the copy page 118 is folded in front-to-front relationship with the original page 116, for reproducing on the front of the copy page information entered (printed) on the back of the original page, the selvages 130*c* and 130*d* are aligned, as are the holes 132*c* and 132*d* in these selvages.

The back-to-back folded sheet 110 may be fed through the tractor feed mechanism of a computer printer for reproducing on the back surface of the copy page information entered on the front surface of the original page, as discussed hereinbefore.

Such tractor feed mechanisms have two sprocket (pin) wheels (not shown). One of the sprocket wheels would feed the folded sheet 110 by acting upon the holes 132*a* and 132*b* in the selvages 130*a* and 130*b*, and the other sprocket wheel would feed the folded sheet by acting upon the holes 132*c* and 132*d* in the selvages 130*c* and 130*d*.

After printing upon the front surface of the original page 116, in the folded configuration shown in FIG. 1S (which printing would be reproduced on the back surface of the copy page 118), the folded sheet 110 would be removed from the printer and refolded, as shown in FIG. 1T. The refolded sheet 110 would be fed through the printer for reproducing on the front surface of the copy page information entered on the back surface of the original page 116, as discussed hereinbefore.

Alternate Embodiment—Selected Void Areas on the Original Page

Figure 1U:
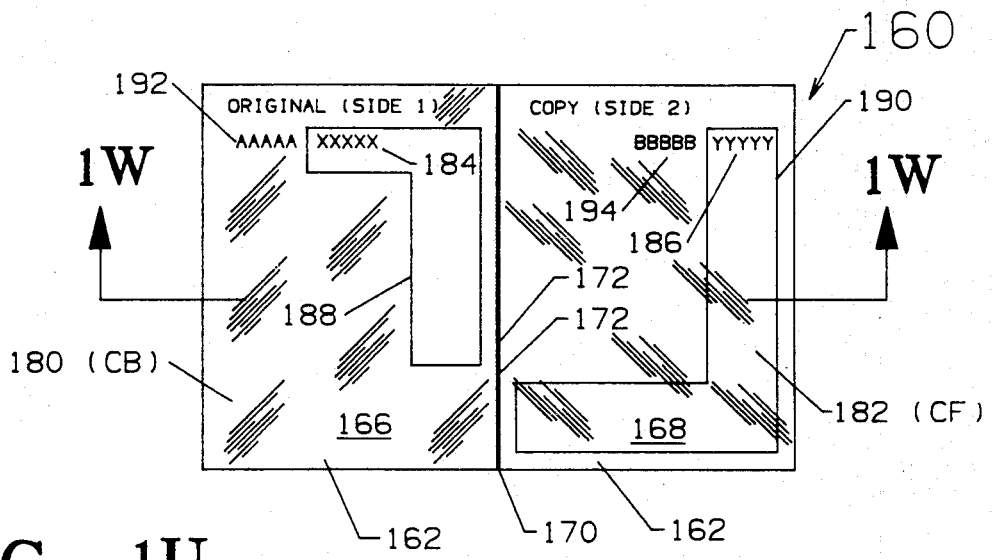
FIGS. 1U-1W
Figure 1V:
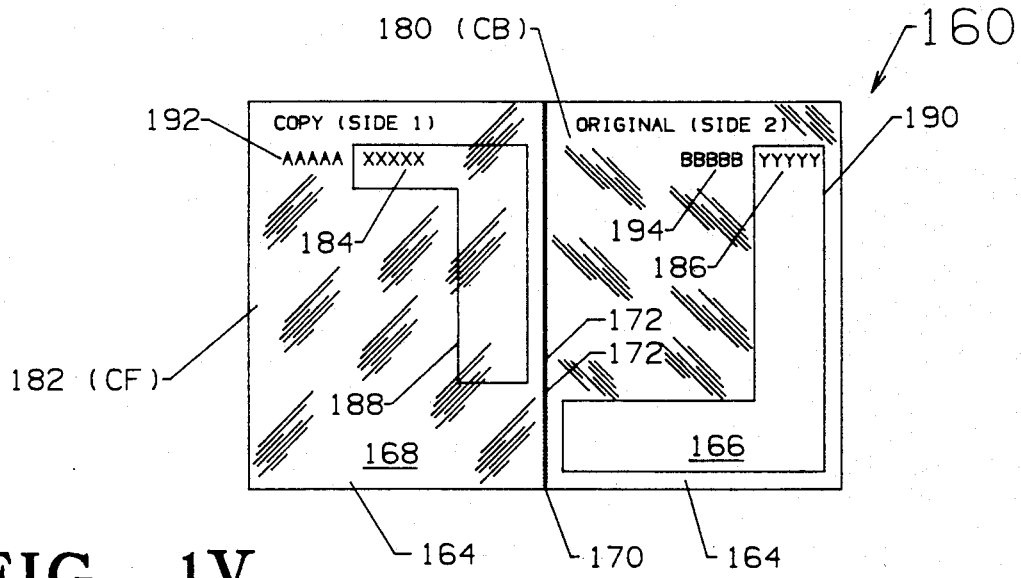
Figure 1W:
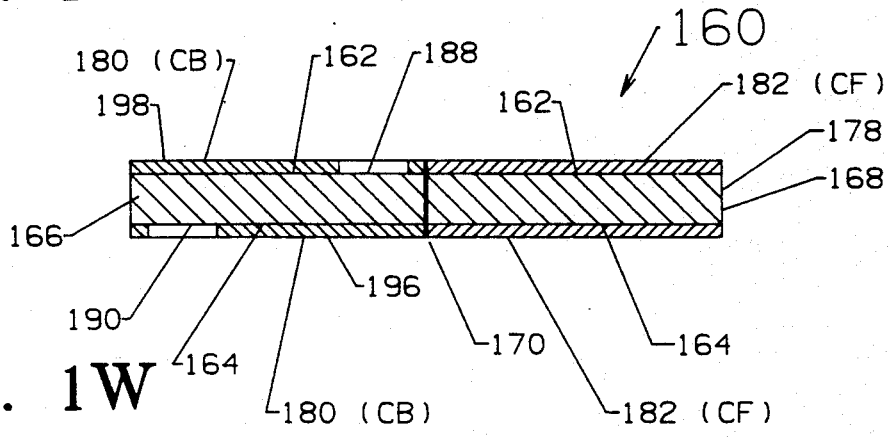

FIGS. 1U, 1V and 1W show an alternate embodiment of the invention, relating most pertinently to the embodiment discussed with respect to FIGS. 1A through 1E. Whereas in the embodiment described with respect to FIGS. 1F-1H only selected areas on the front and back surfaces of the original page were coated with CB carbonless treatment, in the present embodiment all but selected areas on the front and back surfaces of the original page are coated with carbonless CB treatment. This similarly avoids the peculiarities of entering information on the carbonless coating itself.

FIGS. 1U, 1V and 1W are similar to FIGS. 1A, 1B and 1C, and show an alternate embodiment of the invention. A single sheet 160, having a front surface 162 and a back surface 164, is divided by a boundary 170, having perforations 172, into an original page 166 and a copy page 168.

As shown in FIGS. 1U, 1V and 1W, a selected area 188 (not necessarily including a preprinted border) on the front surface 162 of the original page 166 is delineated for entering first information 184 ("XXXXX"). A selected area 190 on the back surface 164 of the original page 166 is delineated for entering second information 36' ("YYYYY"). The first and second selected areas are offset, not in front-to-back alignment with each other. As in the previous embodiment, legends 192 and 194 are juxtaposed with the selected areas 188 and 190, respectively, and the delineated areas 188 and 190 and the legends 192 and 194 are repeated on the copy page 168 and aligned with their counterparts on the original page 168 when the original and copy pages are folded for entering information.

The carbonless CB treatment 180 is applied to the original page 166, as follows. Carbonless CB treatment 180 is applied to an area 196 covering all but the selected area 190 on the back surface 164 of the original page 166, and notably covers an area in front-to-back alignment with the selected area 188 for entering the first information 184 ("XXXXX") on the front surface 162 of the original page 166. Further, carbonless CB treatment 180 is applied to an area 198 covering all but the selected area 188 on the front surface 162 of the original page 166, and notably covers an area in front-to-back alignment with the selected area 190 for entering the second information 186 ("YYYYY") on the back surface 164 of the original page 166. Notably, the CB coated area 198 on the front surface 162 of the original page 166 does not overlap the selected area 188 for entering the first information 184 ("XXXXX") on the front surface 162 of the original page 166. Similarly, the CB coated area 196 on the back surface 164 of the original page 166 does not overlap the selected area 190 for entering the second information 186 ("YYYYY") on the back surface 164 of the original page 166. The non-overlapping of the selected areas coated with carbonless CB treatment 180 with the selected areas for entering information on either side of the original page absolutely prevents any pen skipping or clogging problems, since it is not necessary to write upon the carbonless CB coating as in the embodiment of FIGS. 1A-1C.

The copy page 168 can be completely coated with carbonless CF coating 182, as it was in the embodiment of FIGS. 1A-1C.

In order to effect reproduction of the first information 184 ("XXXXX") entered on the front side 162 of the original page 166 onto the back side 164 of the copy page 168, the copy page 168 is folded under the original page 166, in back-to-back relationship therewith, as described with respect to FIG. 1D.

Similarly, in order to effect reproduction of the second information 186 ("YYYYY") entered on the back side 164 of the original page 166 onto the front surface 162 of the copy page 168, the copy page 168 is folded the opposite way, in front-to-front relationship with the original page 166, as described with respect to FIG. 1E.

The selective application of carbonless CB treatment to all but selected areas of a sheet of paper is simply a variation of applying the carbonless CB treatment to selected areas of a paper ("patterning").

An advantage of the present embodiment over the embodiment described with respect to FIGS. 1F-1H is that in the present embodiment additional information entered on the front surface 162 of the original page 166, outside of the selected area 188 for entering the first information 184 ("XXXXX"), will be reproduced on the copy page 168. Similarly, additional information entered on the back surface 164 of the original page 166, outside of the selected area 190 for entering the second information 186 ("YYYYY"), will be reproduced on the copy page 168. In the embodiment of FIGS. 1F-1H this was not the case. This feature of being able to enter (the first and second) information in the selected areas 188 and 190 which are void of carbonless CB treatment, and additionally entering additional information on the remainder of the original page (outside the selected areas 188 and 190) which is coated with the carbonless CB treatment is advantageous, for instance, in the following context. Consider the case of filling out a Form 1040 (Internal Revenue Service). Most of the taxpayer information is entered in a column-like area along the right-hand side of the front surface of the form and in a column-like area along the right-hand side of the back surface of the form. These two areas are inherently offset, front-to-back. However, additional information, notably certain "check-off" boxes and certain minor calculations are scattered all over the front and back surfaces of the form.

Hence, in an embodiment according to FIGS. 1U-1W, most of the information is entered in areas free of carbonless treatment, thereby avoiding potential pen skipping and clogging, but additional information can be entered in any other area of the original page.

Again, separate original and copy sheets can be provided, but the formation of original and copy pages from a single sheet of paper is advantageously self-aligning.

Multiple Copies

The invention is also useful for making multiple (more than one) copies of an original.

FIGS. 2A, 2B, 2C, 2D and 2E show an embodiment of the invention suitable for producing multiple (more than one) copies of information entered on both sides of an original.

FIGS. 2A through 2E show a single sheet of paper 210 having a front surface 212 and a back surface 214. The sheet is divided into three side-by-side portions (panels) of equal width—a right portion ("original page") 216, a middle portion ("copy page") 217 and a left portion ("copy page") 218. The right and middle portions are delineated by a boundary 220, which is perforated by a line of perforations 222 to facilitate folding and separating the right portion 216 from the middle portion 217. Similarly, the left and middle portions are delineated by a boundary 224, which is perforated by a line of perforations 226 to facilitate folding and separating the left portion 218 from the middle portion 217.

Figure 2A:
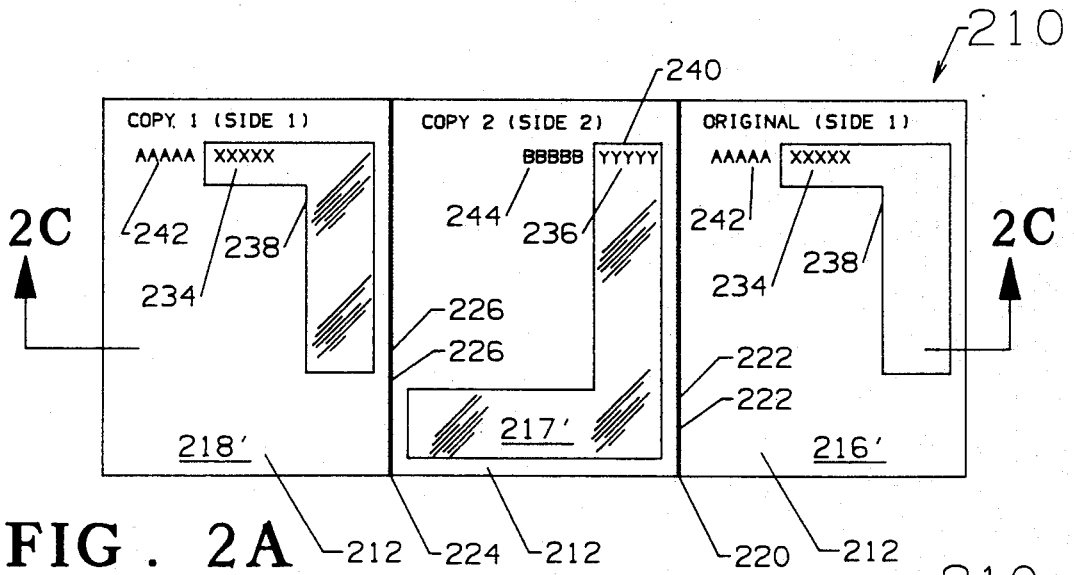
FIGS. 2A-2E

As best viewed in FIG. 2A, the front surface 212 of the right portion (original page) 216 bears the legend "ORIGINAL (SIDE 1)", the front surface 212 of the middle portion (copy page) 217 bears the legend "COPY 2 (SIDE 2)", and the front surface 212 of the left portion (copy page) 218 bears the legend "COPY 1 (SIDE 1)".

Figure 2B:
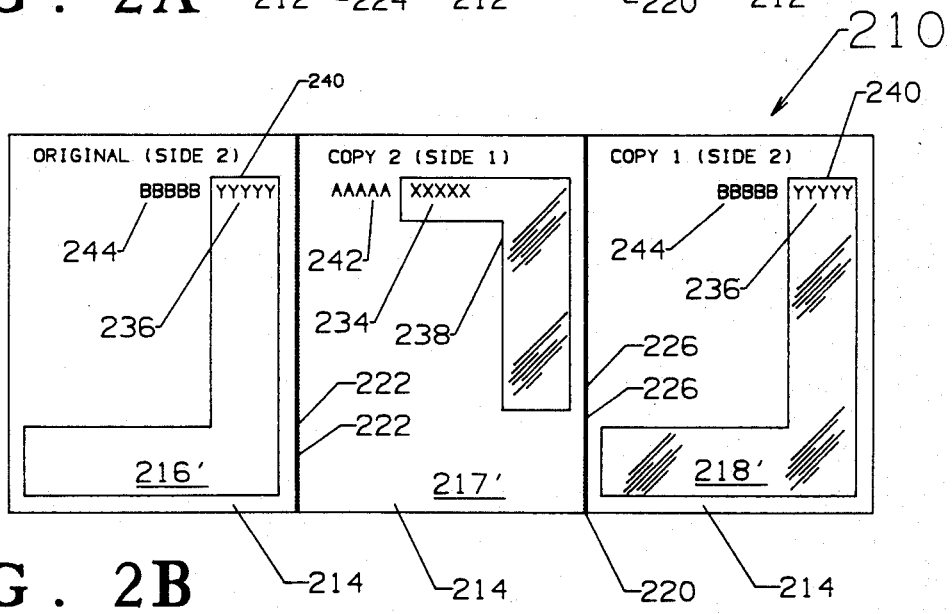

As best viewed in FIG. 2B, the back surface 214 of the original page 216 bears the legend "ORIGINAL (SIDE 2)", the back surface 214 of the middle portion (copy page) 217 bears the legend "COPY 2 (SIDE 1)", and the back surface 214 of the left portion (copy page) 218 bears the legend "COPY 1 (SIDE 2)". No particular meaning is intended to be ascribed to these legends other than that they are useful in understanding the invention.

As in the previously described embodiments, selected areas 238 and 240 on the front and back surfaces 212 and 214 of the original page 216 are designated for entering first and second information 234 and 236, respectively, and corresponding areas 238 and 240 on the front and back surfaces of the copy pages 217 and 218 are designated for reproducing the first and second information. Legends 242 and 244 are similarly associated with the areas 238 and 240 for entering information.

In this first embodiment directed to the making of multiple copies of an original, selected areas of the copy pages 217 and 218 (i.e., of the paper 228 itself) are coated with carbonless SC treatment, in the following manner.

An area 246 on the back surface 214 of the copy page 217 is treated with carbonless SC treatment 230 for reproducing the first information 234 entered in the selected area 238 on the front surface 212 of the original page 216. This area 246 is essentially the selected area 238 on the back surface 214 of the copy page 217.

An area 248 on the front surface 212 of the copy page 217 is treated with carbonless SC treatment 230 for reproducing the second information 236 entered in the selected area 240 on the back surface 214 of the original page 216. This area 248 is essentially the selected area 240 on the front surface 212 of the copy page 217.

Similarly, an area 247 on the front surface 212 of the copy page 218 is treated with carbonless SC treatment 230 for reproducing the first information 234 entered in the selected area 238 on the front surface 212 of the original page 216. This area 247 is essentially the selected area 238 on the front surface 212 of the copy page 218.

And, an area 249 on the back surface 214 of the copy page 218 is treated with carbonless SC treatment 230 for reproducing the second information 236 entered in the selected area 240 on the back surface 214 of the original page 216. This area 249 is essentially the selected area 240 on the back surface 214 of the copy page 218.

Figure 2C:
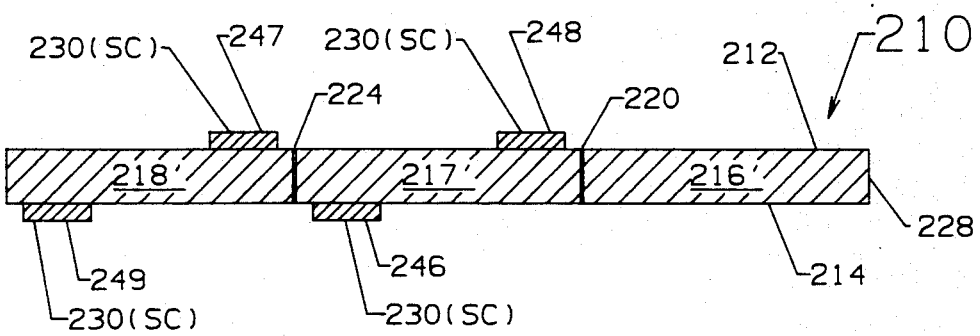
Figure 2D:
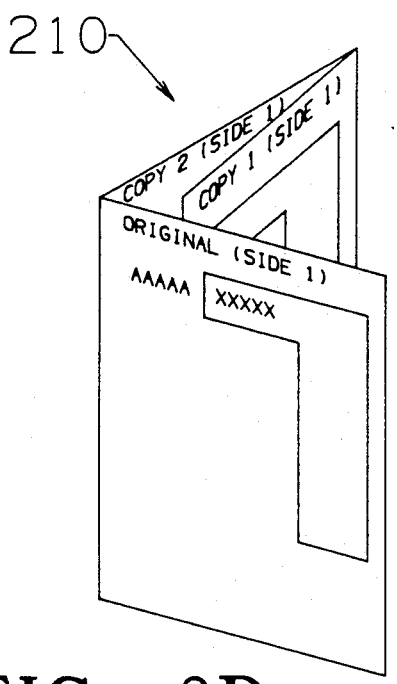
Figure 2E:
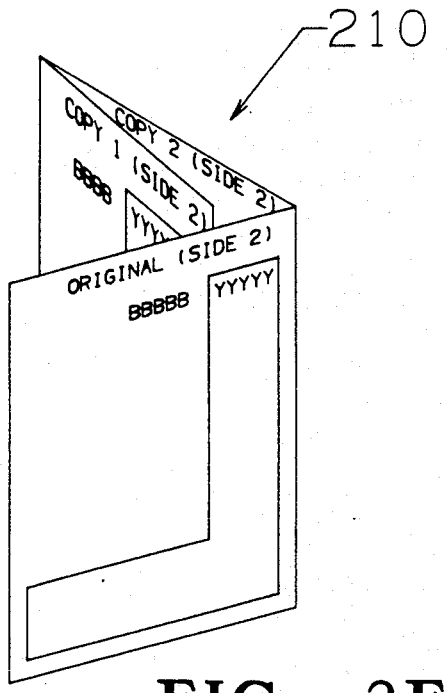

FIGS. 2D and 2E show one way in which the original and copy pages can be folded to produce multiple copies.

Figure 2F:
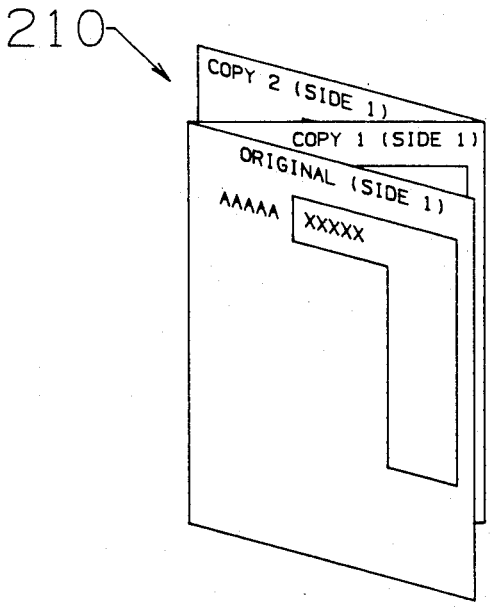
FIGS. 2F-2G
Figure 2G:
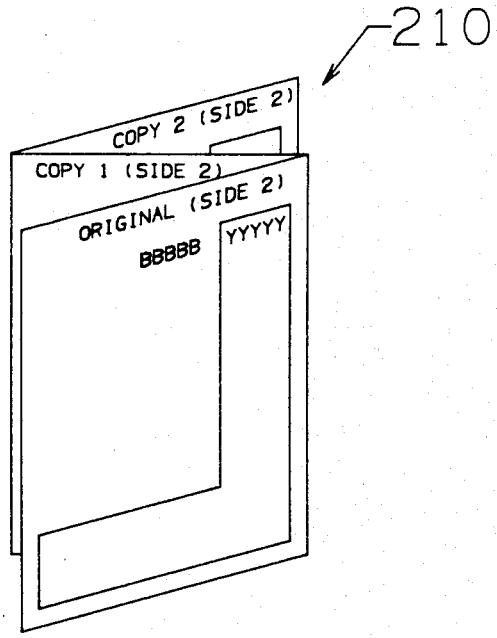

FIGS. 2F and 2G show another way in which the original and copy pages can be folded to produce multiple copies. Noticeably, when the sheet 210 is folded in this manner, the legends are different since the middle panel 217 becomes "COPY 1" and the left panel 218 becomes "COPY 2". This illustrates, however, that no matter how you fold the sheet 210, so long as you write on the original panel 216, two-sided copies 217 and 218 of that information will be appropriately reproduced.

FIGS. 2H, 2I, 2J, 2K and 2L show a multi-panel carbonless copy paper 210' essentially the same as that which was discussed with respect to FIGS. 2A-2C, with the exception that another (the middle) of the three panels serves as the original page. Hence, the middle panel is not coated, and the end panels are coated in areas where information will be reproduced.

Figure 2H:
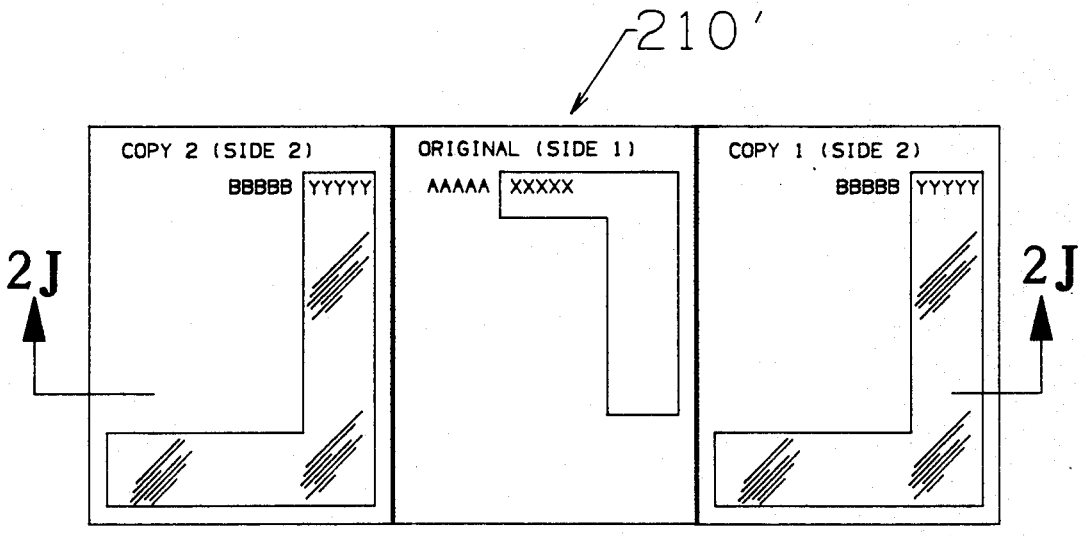
FIGS. 2H-2L
Figure 2I:
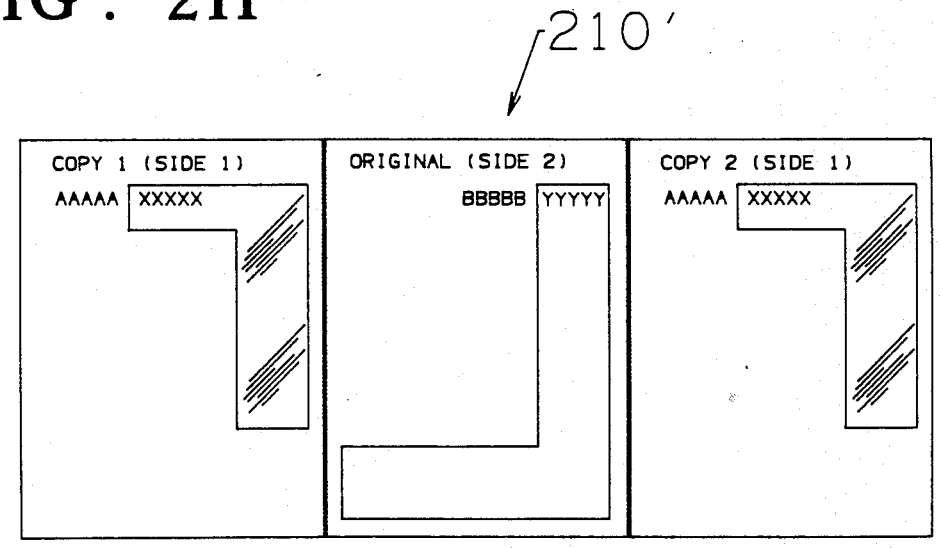
Figure 2J:
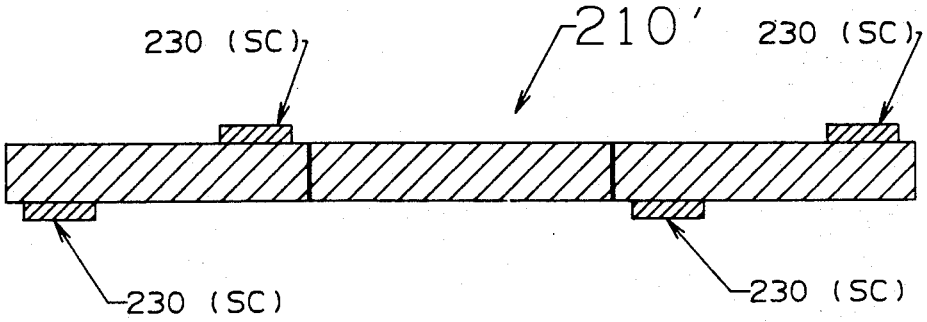
Figure 2K:
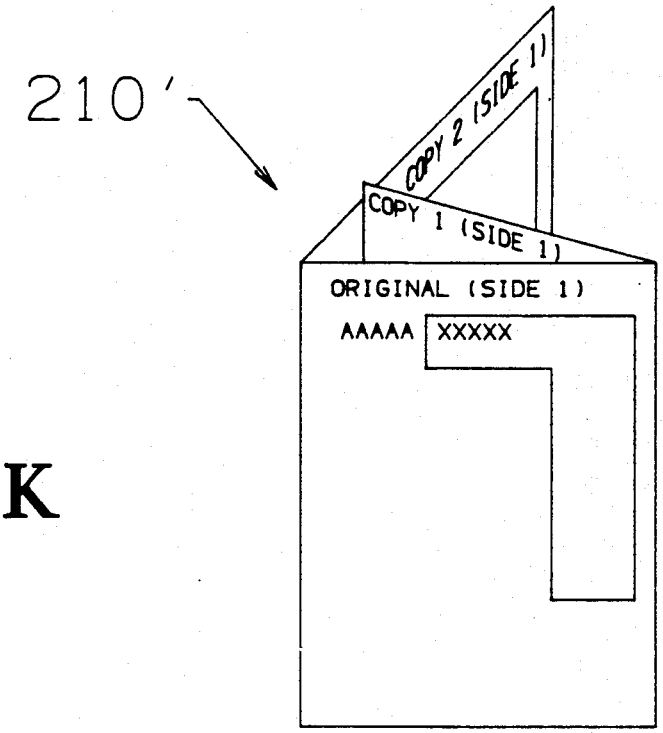
Figure 2L:
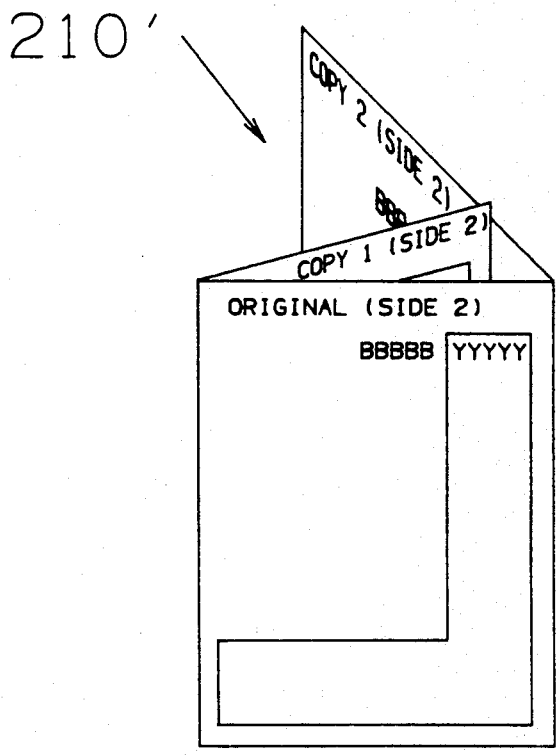

FIGS. 2K and 2L illustrate one possible folding of the carbonless copy paper 210'.

Figure 2M:
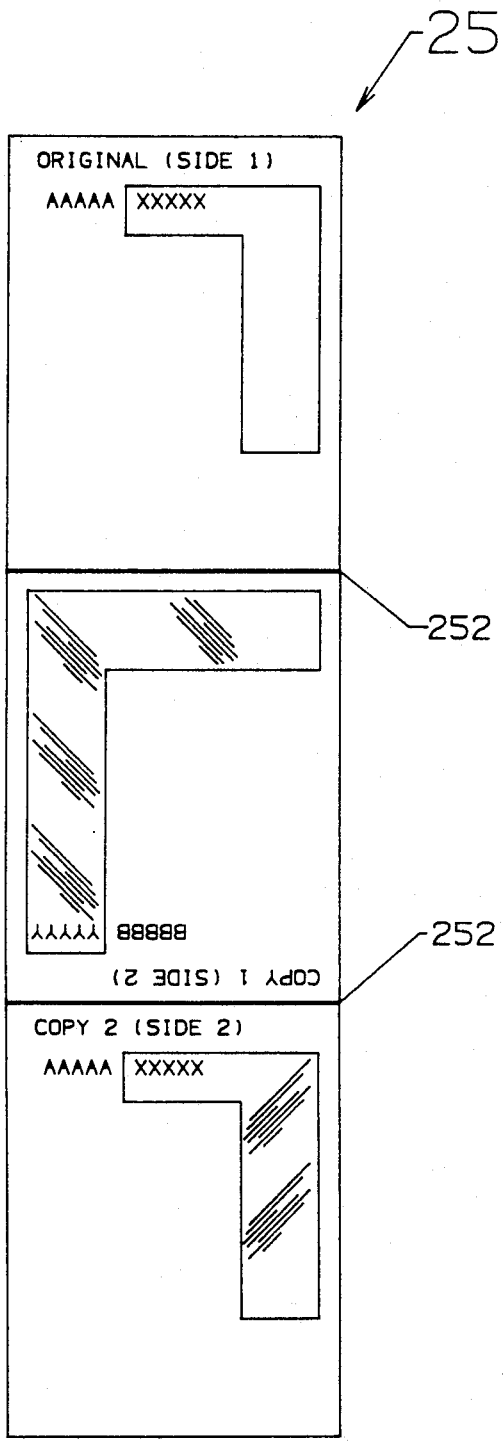
FIGS. 2M-2N
Figure 2N:
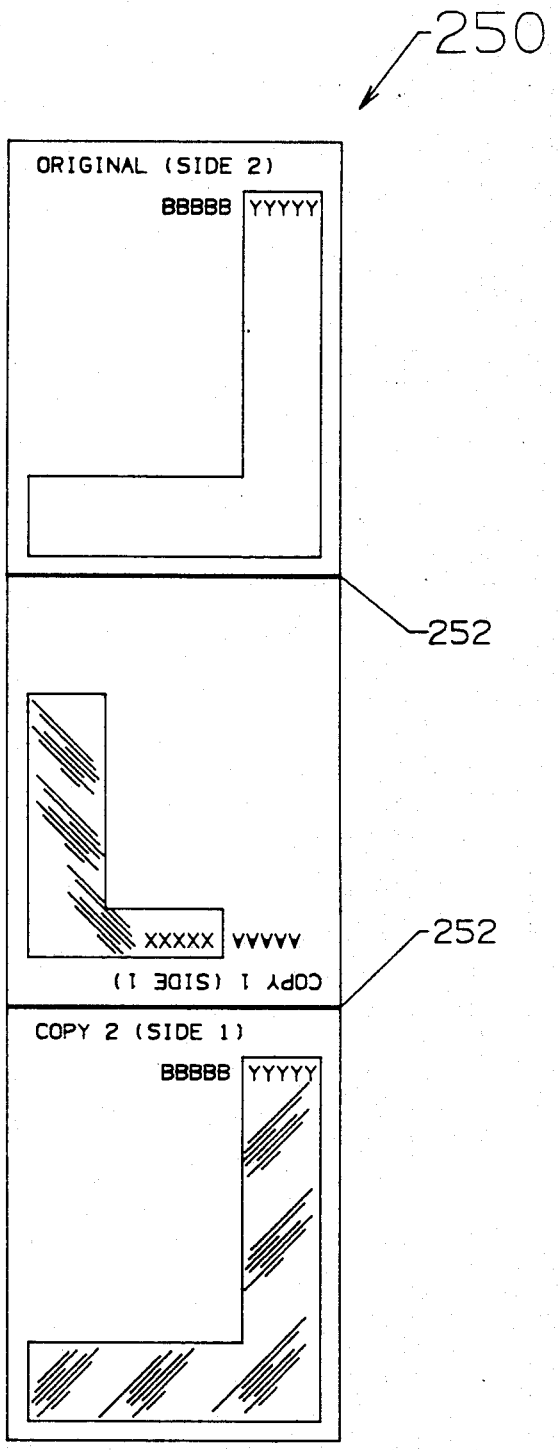

FIGS. 2M and 2N show a multi-panel carbonless copy paper 250 essentially the same as that which was discussed with respect to FIGS. 2A-2C, with the exception that the panels have a vertical orientation and are divided by horizontal, perforated boundaries 252.

This illustrates that any of the three panels can serve as the original page, and the orientation of the panels can be horizontal (divided by a vertical boundary) or vertical (divided by a horizontal boundary). As discussed hereinbefore, the original page is nominally white, and the copy pages are typically dissimilarly colored pink, buff, canary or the like. So no matter how you fold it, and no matter which page is the original page, multiple copies of the original are produced.

As in the single copy embodiments, the formation of the three pages (panels) from a single sheet of paper is advantageous with respect to folding and separating the original and copy pages. However, these pages may be separate sheets.

Alternate Embodiment—CB and CF Coatings

Figure 2P:
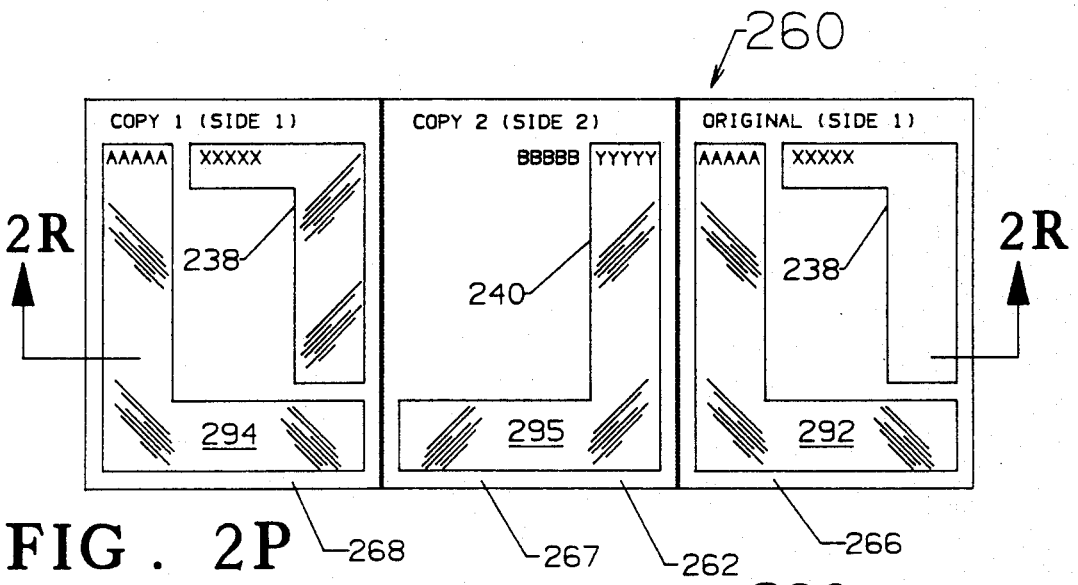
FIGS. 2P-2R
Figure 2Q:
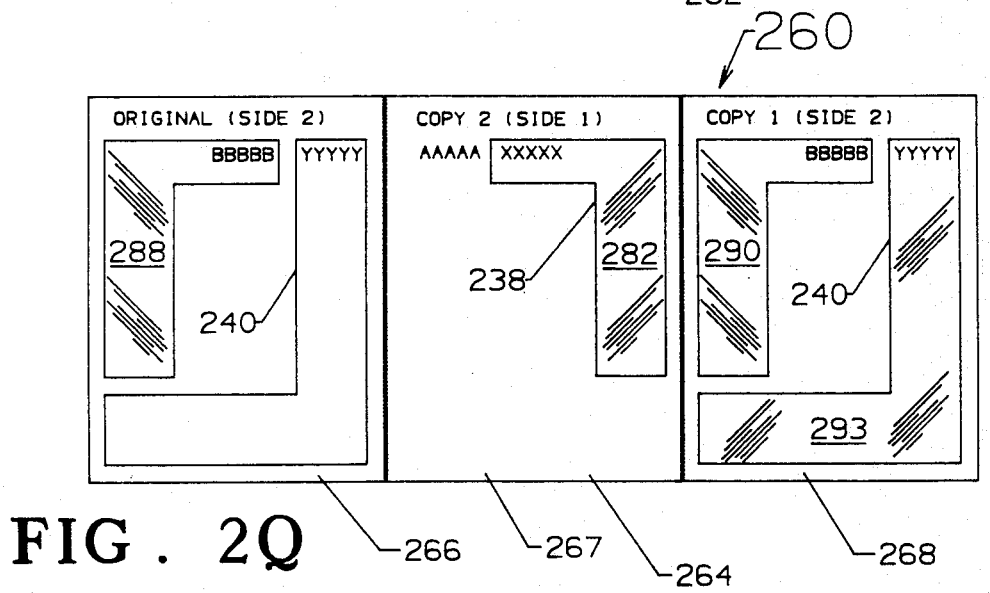
Figure 2R:
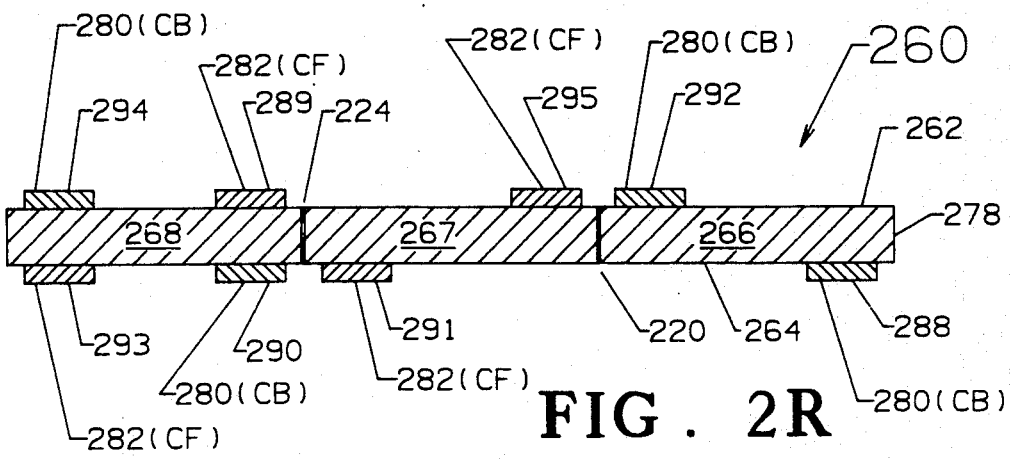

FIGS. 2P, 2Q and 2R show carbonless copy paper 260, and illustrates that multiple copies can be made by applying carbonless CB and CF treatments to selected areas on the various panels.

As in the previously described embodiment of FIGS. 2A-2C, a sheet of paper 260 has a front surface 262 and a back surface 264, and is divided into three pages (panels) 266, 267 and 268 by perforated boundaries 270 and 271. The various areas 238 and 240 for entering and reproducing information, as well as the legends associated therewith, are as described with respect to FIGS. 2A-2C.

Carbonless CB and CF coatings are applied to the original and copy pages in the following manner.

An area 288 on the back side 264 of the original page 266, in front-to-back alignment with the area 238 on the front side 262 of the original page 266 for entering the first information, is coated with carbonless CB treatment 280. An area 289 on the front side 262 of the left panel (copy page) 268, which is essentially the area 238 for reproducing the first information on the front side 262 of the left panel 268, is coated with carbonless CF treatment 282. An area 290 on the back side 264 of the left panel 268, in front-to-back alignment with the area 289 on the front side 264 of the left panel 268, is coated with carbonless CB treatment 280. An area 291 on the back side 264 of the middle panel (copy page) 267, which is essentially the area 238 for reproducing the first information on the back side 264 of the middle panel 267, is coated with carbonless CF treatment 282. In use, when the panels 266, 267 and 268 are folded as shown in FIG. 2D, (first) information entered in the area 238 on the front side 262 of the original page 266 is reproduced in the CF coated area 238 on the front side 262 of the left panel 268, and is also reproduced in the CF coated area 238 on the back side 264 of the middle panel 267.

Further, an area 292 on the front side 262 of the original page 266, in front-to-back alignment with the area 240 on the back side 264 of the original page 266 for entering the second information, is coated with carbonless CB treatment 280. An area 293 on the back side 264 of the left panel 268, which is essentially the area 240 for reproducing the second information on the back side 264 of the left panel 268, is coated with carconless CF treatment 282. An area 294 on the front side 262 of the left panel 268, in front-to-back alignment with the area 293 on the back side 264 of the left panel 268, is coated with carbonless CB treatment 280. An area 295 on the front side 262 of the middle panel 267, which is essentially the area 240 for reproducing the second information on front side 262 of the middle panel 267, is coated with carbonless CF treatment 282.

In use, when the panels are re-folded as shown in FIG. 2E, (second) information entered in the area 240 on the back side 264 of the original page 266 is reproduced in the CF coated area 240 on the back side 264 of the left (copy) page 268, and is also reproduced in the CF coated area 240 on the front side 262 of the middle (copy) page 267.

In a similar manner as was described with respect to FIGS. 2F and 2G, the original and copy pages 266, 267 and 268 could be folded in zig-zag fashion. In this case, the left panel 268 would be the second copy page and the carbonless CB treatments in the ares 290 and 294 would be superfluous. However, areas of carbonless CB treatment in front-to-back alignment with the areas 291 and 295 of carbonless CF treatment on the middle panel 267 would be required. This is not shown.

Further, in a similar manner as was described with respect to FIGS. 2H, 2I and 2J, the middle panel (267) could be the "original" page. The carbonless CB and CF coatings would be arranged accordingly.

Vertical orientations of the panels, with horizontal borders therebetween are also possible. In all of the multiple-copy embodiments, the pages (panels) may also be provided with selvages, as was discussed with respect to FIGS. 1R, 1S and 1T, for use in tractor feed type printers.

As in all previous embodiments of the invention, forming the original and copy pages from a single sheet of paper is highly advantageous, but separate sheets could be used.

Chemical Carbonless Technology

Chemical carbonless copy technology is now described. It should be understood that virtually any known technology could be employed with the present invention, and that for particular applications, particular variations of the technology may be more useful than others. Generally, it is important that the selected technology be suitable in terms of producing clear, non-smudged copies. Further, the cost of the particular technology must be weighed against its ultimate use. Lastly, certain concerns have been raise about possible allergic reactions to carbonless treatments.

Chemical carbonless copy technology is described, for instance, in *Microencapsulation*, Drugs and the Pharmaceutical Sciences, Volume 3, copyright 1976 by Marcel Dekker, Inc., 270 Madison Ave., New York, N.Y., edited by J. R. Nixon, Library of Congress Catalog Card No. 75-37112, ISBN 0-8247-6338-6. At pages 31–36 therein, the preparation of carbonless copy paper is discussed.

In general, there are four areas of variation from one carbonless technology to another. They are solvents, color formers and capsule wall material, all of which relate to the CB coating, and coreactant surface, which relates to the CF coating.

Suitable CB coatings

Generally, a suitable CB coating is prepared in a colorless state, dissolved in a solvent, and then encapsulated in microscopic capsules (below 10 micron diameter) which are made of gelatin and gum arabic, carbomethylcellulose, or high molecular weight synthetic co-polymers. These capsules are in an emulsion which is spread, dried, and held adherent to the undersurface of the paper with a water soluble starch.

Solvents

From the original NCR paper until 1970, the main solvent was a chlorobiphenyl (Aroclor). However, because of environmental objections to this type of solvent, the polychlorinated biphenyls have been replaced by solvents such as hydrogenated terphenyls, di-arylethanes, alkylnaphthalenes, cyclohexane and dibutylphthalate. These materials are often diluted (for economic reasons) with odorless kerosene.

Color Formers

As of 1979, only a small range of color formers were employed. The triphenyl and triaryl methane group were the commonest. They are encapsulated in a colorless form and can be acidified or oxidized (by the coreactant CF surface) to produce a colored image. Examples include crystal violet lactone, benzoyl leucomethylene blue, fluoran derivatives, Malachite green and lactone.

Capsule Material

Gelatin was originally used with gum arabic, but carboxymethyl cellulose and synthetic polymers became frequently used by 1979. The polymers include poluamides, polyesters and polyurethanes.

Suitable CF Coatings

A suitable CF coating contains a Montmorillonite clay which is alkaline on the surface but acidic inside, or an alternative coreacting system material. It is spread in a mixture, dried and adhered to the paper with a styrene butadiene latex.

Suitable SC Coatings

A suitable "SC", or Self-Contained coating contains a mixture of carbonless CB and CF coatings, as discussed hereinbefore. Pressure applied to a surface coated with such a "hermaphroditic" treatment will cause an image to appear. Thus, the SC coating is suitable for use on a sheet underlying a non-treated, plain paper original.

SUMMARY

The present invention is directed to the making of two-sided copies from two-sided originals (in other words, of both sides of an original). Generally, this result is obtained by a novel arrangement of known carbonless coatings on the surfaces of the pages, and does not require any new "chemistry". One or more copies of an original can be made in this manner. Further, when a single sheet of paper is divided into an original page and a copy page, by folding the original and copy pages as described above the original and copy pages are self-aligning. This self-alignment feature has applicability even when only one-sided copying is desired.

The potential impact of the above-described, self-replicating, form (in any of the embodiments) is tremendous. As mentioned hereinbefore, no longer would there be a need for photocopying or transcribing in order to retain a record of the original form or document. Further, for forms which require more information than can be provided on a single side of a page, the invention provides a technique wherein both sides of a page can be utilized. This has the potential of not only cutting in half form usage (and consequent cost), but will also inevitably lead to new uses for forms. The utility of producing two-sided copies is indicated by the proliferation of photocopying machines that are capable of producing two-sided copies, although the present invention is in no way suggested thereby.

What is claimed is:

1. A single sheet of Carbonless copy paper, consisting essentially of:

a single sheet of paper having a front surface and a back surface and delineated into two portions;

carbonless CB treatment applied to the front and back surfaces of one of the two portions; and carbonless CF treatment applied to the front and back surfaces of the other of the two portions;

wherein:

writing on one surface of the one portion is carbonless imaged onto one surface of the other portion when the sheet is folded one way;

writing on an opposite surface of the one portion is carbonless imaged onto an opposite surface of the other portion when the sheet is folded an opposite way; and the sheet is of uniform thickness when folded either way.

2. A single sheet of Carbonless copy paper according to claim 1, wherein:

a boundary delineating the two portions is perforated to facilitate separation of the one portion from the other portion.

3. A single sheet of Carbonless copy paper according to claim 1, wherein:

a boundary delineating the two portions is vertical and delineates the sheet of paper horizontally into two side-by-side portions.

4. A single sheet of Carbonless copy paper according to claim 1, wherein:

a boundary delineating the two portions is horizontal and delineates the sheet of paper vertically into two portions, one portion disposed above the other portion.

5. A single sheet of Carbonless copy paper according to claim 1, wherein:

the front surface of the one portion has a first selected area for entering first information on the front surface of the one portion;

the back surface of the one portion has a second selected area for entering second information on the back surface of the one portion;

the first selected area is offset front-to-back from the second selected area on the one portion;

the carbonless CB treatment is applied to the back surface of the one portion only in a third selected area in front-to-back alignment with the first selected area on the one portion; and the carbonless CB treatment is applied to the front surface of the one portion only in a fourth selected area in front-to-back alignment with the second selected area on the one portion.

6. A single sheet of Carbonless copy paper according to claim 5, wherein:

the fourth selected area does not overlap with the first selected area on the front surface of the one portion; and the third selected area does not overlap with the second selected area on the back surface of the one portion.

7. A single sheet of Carbonless copy paper according to claim 5, wherein:

the back surface of the other portion has a fifth selected area for revealing an image of the first information; and the front surface of the other portion has a sixth selected area for revealing an image of the second information.

8. A single sheet of Carbonless copy paper according to claim 1, wherein:

the front surface of the one portion is preprinted with first information;

the back surface of the one portion is preprinted with second information;

the back surface of the other portion is preprinted with the first information; and the front surface of the other portion is preprinted with the second information.

9. A single sheet of Carbonless copy paper according to claim 1, wherein:

a boundary delineating the two portions is a fold line;

the other portion is foldable one way in back-to-back relationship with the one portion; and the other portion is foldable another opposite way in front-to-front relationship with the one portion.

10. A single sheet of Carbonless copy paper according to claim 1, wherein:

the front surface of the one portion is preprinted with markings designating a first selected area for entering first information on the front surface of the one portion; and the back surface of the one portion is preprinted with markings designating a second selected area for entering second information on the back surface of the one portion.

11. A single sheet of Carbonless copy paper according to claim 1, wherein:

the one and other portions are dissimilarly colored.

12. A single sheet of Carbonless copy paper according to claim 11, wherein:

the one portion is colored white.

13. A single sheet of Carbonless copy paper according to claim 1, further comprising:

selvages provided along opposite edges of the one and the other portions; and tractor feed-type holes provided along the selvages.

14. A single sheet of Carbonless copy paper according to claim 1, wherein:

the carbonless CB treatment is applied to a first selected area on the front surface of the one portion;

the carbonless CB treatment is applied to a second selected area on the back surface of the one portion; and the first and second selected areas are offset front-to-back on the one portion.

15. A single sheet of Carbonless copy paper according to claim 14, wherein:

the carbonless CF treatment is applied to a third selected area on the back surface of the other portion;

the carbonless CB treatment is applied to a fourth selected area on the front surface of the other portion; and the third and fourth selected areas are offset front-to-back on the other portion.

16. A single sheet of Carbonless copy paper according to claim 1, wherein:

the carbonless CB treatment is applied to substantially the entire front surface of the one portion; and the carbonless CB treatment is applied to substantially the entire back surface of the one portion, in a manner that there is a front-to-back alignment between the CB treatment on the one portion.

17. A single sheet of Carbonless copy paper according to claim 16, wherein:

the carbonless CF treatment is applied to substantially the entire back surface of the other portion; and the carbonless CF treatment is applied to substantially the entire front surface of the other portion, in a manner that there is a front-to-back alignment between the CF treatment on the other portion.

18. A single sheet of Carbonless copy paper, consisting of:

a single sheet of paper having a front surface and a back surface and delineated into two portions;

a carbonless CB coating applied to the front and back surfaces of one of the two portions; and a carbonless CF coating applied to the front and back surfaces of the other of the two portions;

wherein:

writing on one surface of the one portion is carbonless imaged onto one surface of the other portion when the sheet is folded one way;

writing on an opposite surface of the one portion is carbonless imaged onto an opposite surface of the other portion when the sheet is folded an opposite way; and the sheet is of uniform thickness when folded either way.

19. A single sheet of Carbonless copy paper according to claim 18, wherein:

a boundary delineating the two portions is perforated to facilitate separation of the one portion from the other portion.

20. A single sheet of Carbonless copy paper according to claim 18, wherein:

a boundary delineating the two portions is vertical and delineates the sheet of paper horizontally into two side-by-side portions.

21. A single sheet of Carbonless copy paper according to claim 18, wherein:

a boundary delineating the two portions is horizontal and delineates the sheet of paper vertically into two portions, one portion disposed above the other portion.

22. A single sheet of Carbonless copy paper according to claim 18, wherein:

the front surface of the one portion has a first selected area for entering first information on the front surface of the one portion;

the back surface of the one portion has a second selected area for entering second information on the back surface of the one portion;

the first selected area is offset front-to-back from the second selected area on the one portion;

the carbonless CB treatment is applied to the back surface of the one portion only in a third selected area in front-to-back alignment with the first selected area on the one portion; and the carbonless CB treatment is applied to the front surface of the one portion only in a fourth selected area in front-to-back alignment with the second selected area on the one portion.

23. A single sheet of Carbonless copy paper according to claim 22, wherein:

the fourth selected area does not overlap with the first selected area on the front surface of the one portion; and the third selected area does not overlap with the second selected area on the back surface of the one portion.

24. A single sheet of Carbonless copy paper according to claim 22, wherein:

the back surface of the other portion has a fifth selected area for revealing an image of the first information; and the front surface of the other portion has a sixth selected area for revealing an image of the second information.

25. A single sheet of Carbonless copy paper according to claim 18, wherein:

the front surface of the one portion is preprinted with first information;

the back surface of the one portion is preprinted with second information;

the back surface of the other portion is preprinted with the first information; and the front surface of the other portion is preprinted with the second information.

26. A single sheet of Carbonless copy paper according to claim 18, wherein:

a boundary delineating the two portions is a fold line;

the other portion is foldable one way in back-to-back relationship with the one portion; and the other portion is foldable another opposite way in front-to-front relationship with the one portion.

27. A single sheet of Carbonless copy paper according to claim 18, wherein:

the front surface of the one portion is preprinted with markings designating a first selected area for entering first information on the front surface of the one portion; and the back surface of the one portion is preprinted with markings designating a second selected area for entering second information on the back surface of the one portion.

28. A single sheet of Carbonless copy paper according to claim 18, wherein:

the one and other portions are dissimilarly colored.

29. A single sheet of Carbonless copy paper according to claim 28, wherein:

the one portion is colored white.

30. A single sheet of Carbonless copy paper according to claim 18, further comprising:

selvages provided along opposite edges of the one and the other portions; and tractor feed-type holes provided along the selvages.

31. A single sheet of Carbonless copy paper according to claim 18, wherein:

the carbonless CB treatment is applied to a first selected area on the front surface of the one portion;

the carbonless CB treatment is applied to a second selected area on the back surface of the one portion; and the first and second selected areas are offset front-to-back on the one portion.

32. A single sheet of Carbonless copy paper according to claim 31, wherein:

the carbonless CF treatment is applied to a third selected area on the back surface of the other portion;

the carbonless CB treatment is applied to a fourth selected area on the front surface of the other portion; and the third and fourth selected areas are offset front-to-back on the other portion.

33. A single sheet of Carbonless copy paper according to claim 18, wherein:

the carbonless CB treatment is applied to substantially the entire front surface of the one portion; and the carbonless CB treatment is applied to substantially the entire back surface of the one portion, in a manner that there is a front-to-back alignment between the CB treatment on the one portion.

34. A single sheet of Carbonless copy paper according to claim 33, wherein:

the carbonless CF treatment is applied to substantially the entire back surface of the other portion; and the carbonless CF treatment is applied to substantially the entire front surface of the other portion, in a manner that there is a front-to-back alignment between the CF treatment on the other portion.

35. A method of reproducing onto a copy panel of a single sheet of paper information written or printed on both sides of an original panel of the same single sheet of paper, comprising:

providing a single sheet of paper having a front surface and a back surface and delineated into two panels, one of the two panels serving as an original panel and the other of the two panels serving as a copy panel, wherein a carbonless treatment has been applied to at least the front and back surfaces of the copy panel;

folding the single sheet of paper in one direction so that the copy panel is aligned in back-to-back relationship with the original panel;

entering, by printing or writing, first information on the front surface of the original panel, which first information is reproduced onto the back surface of the copy panel;

folding the single sheet of paper in an opposite direction so that the copy panel is aligned in front-to-front relationship with the original panel; and entering, by writing or printing, second information on the back surface of the original panel, which second information is reproduced onto the front surface of the copy panel.

36. A method of reproducing onto a copy panel of a single sheet of paper information written or printed on both sides of an original panel of the same single sheet of paper, according to claim 35, wherein:

carbonless treatment is applied to the front and back surfaces of the original panel.

37. A method of reproducing onto a copy panel of a single sheet of paper information written or printed on both sides of an original panel of the same single sheet of paper, according to claim 36, wherein:

the carbonless treatment applied to the front and back surfaces of the original panel is carbonless CB treatment; and the carbonless treatment applied to the front and back surfaces of the copy panel is carbonless CF treatment.

* * * * *